US006166346A

United States Patent [19]

Yamashita et al.

[11] Patent Number: 6,166,346

[45] Date of Patent: Dec. 26, 2000

[54] APPARATUS FOR SORTING SHEETS OR THE LIKE

[75] Inventors: Taichiro Yamashita; Yasunori Hamada, both of Tsuchiura; Kazushi Yoshida, Ibaraki-ken; Tadashi Osaka, Ibaraki-ken; Junichi Tamamoto, Ibaraki-ken, all of Japan

[73] Assignee: Hitachi, Ltd., Tokyo, Japan

[21] Appl. No.: 09/373,738

[22] Filed: Aug. 13, 1999

Related U.S. Application Data

[62] Division of application No. 09/030,766, Feb. 26, 1998, Pat. No. 5,990,438, which is a division of application No. 08/734,128, Oct. 21, 1996, Pat. No. 5,749,473, which is a continuation of application No. 08/362,877, Dec. 23, 1994, Pat. No. 5,593,044.

[30] Foreign Application Priority Data

Dec. 28, 1993 [JP] Japan ..... 5-334947

[51] Int. Cl.[7] ..... B07C 5/36; B65H 85/00

[52] U.S. Cl. ..... 209/584; 209/900; 271/3.14; 271/163; 271/213

[58] Field of Search ..... 209/554, 563, 209/564, 569, 583, 584, 900; 271/2, 3.01, 3.12, 3.13, 3.14, 4.01, 149, 163, 218, 213

[56] References Cited

U.S. PATENT DOCUMENTS

| | | | |
|---|---|---|---|
| 4,757,904 | 7/1988 | Ozawa | 271/301 X |
| 4,891,088 | 1/1990 | Svyatsky | 209/900 X |
| 5,097,959 | 3/1992 | Tilles et al. | 209/584 |
| 5,109,987 | 5/1992 | Daboub et al. | 271/225 X |
| 5,143,225 | 9/1992 | Rabindran et al. | 209/584 |
| 5,324,927 | 6/1994 | Williams | 209/584 X |
| 5,363,971 | 11/1994 | Weeks et al. | 209/900 X |
| 5,421,464 | 6/1995 | Gillmann et al. | 209/584 |

FOREIGN PATENT DOCUMENTS

| | | | |
|---|---|---|---|
| 566456 | 10/1993 | European Pat. Off. | 209/584 |
| 51-105897 | 9/1976 | Japan . | |
| 58-170579 | 10/1983 | Japan . | |
| 58-170580 | 10/1983 | Japan . | |
| 197361 | 9/1986 | Japan | 209/900 |
| 63-202560 | 8/1988 | Japan . | |
| 63-287584 | 11/1988 | Japan . | |
| 8403680 | 7/1986 | Netherlands | 209/584 |

*Primary Examiner*—Tuan N. Nguyen

*Attorney, Agent, or Firm*—Antonelli, Terry, Stout & Kraus, LLP

[57] ABSTRACT

An apparatus for sorting and distributing sheet-like items, such as postal matter. A feeder successively feeds the sheet-like items to a stacker which is positioned above the feeder and on which the sheet-like items are stacked in an upright position. Both the feeder and the stacker have a bottom surface. The bottom surface of the stacker is normally positioned at a first distance above the bottom surface of the feeder. A bottom surface opening mechanism is able to open the bottom surface of the stacker to permit sheet-like items stacked in the stacker to be transferred to the feeder. A bottom surface moving mechanism is able to move the bottom surface of the feeder unit and the bottom surface of the stacker unit toward each other so as to position the stacker bottom surface at a second distance above the feeder bottom surface, with the second distance being less than the first distance, and is able to return the bottom surfaces to a position in which they are spaced by the first distance.

8 Claims, 21 Drawing Sheets

| STACKING SECTION | ADDRESS |
|---|---|
| 1 | FIRST STREET |
| 2 | SECOND STREET |
| 3 | THIRD STREET |
| ⋮ | ⋮ |
| 11 | FIRST AVENUE |
| 12 | SECOND AVENUE |

14

APPARATUS FOR SORTING SHEETS OR THE LIKE

CROSS-REFERENCE TO RELATED APPLICATIONS

This application is a divisional application of application Ser. No. 09/030,766, filed Feb. 26, 1998, which is a divisional application of application Ser. No. 08/734,128, filed Oct. 21, 1996, now U.S. Pat. No. 5,749,473, which was a continuation of application Ser. No. 08/362,877 filed Dec. 23, 1994 and now U.S. Pat. No. 5,593,044.

BACKGROUND OF THE INVENTION

The present invention relates to an apparatus for sorting sheets or the like, which reads address codes, e.g., bar codes, applied to the sheets or the like, such as mail, and distributes the introduced sheets or the like in accordance with the address codes. More particularly, the invention relates to an apparatus for sorting sheets or the like which enables carrier route sequencing of mail, i.e., sequencing the volume of mail by carrier routes in accordance with address codes.

A conventional apparatus for reading address codes applied to sheets or the like such as mail and sequencing the incoming sheets or the like in the order indicated by the address codes is, for example, a carrier route sequencing system for sheets or the like which is disclosed in Japanese Patent Unexamined Publication No. 63-287584.

In this conventional system, addresses of delivery points of sheets or the like are inputted, and the sheets or the like are sorted into portions corresponding to delivery zones in accordance with the inputted addresses. During this operation, the addresses and the number of fed sheets or the like for each of the delivery zones are stored in a storage unit. Then, the stored addresses are sequenced into the carrier route order and stored again. Next, each of the portions of the sheets or the like sorted in accordance with the delivery zones are taken out of a stacker device and supplied to a feeder device again. After that, the addresses are read again and checked with the addresses in the carrier route order stored in the storage unit, thus sorting the sheets or the like in accordance with the carrier route order.

In the above-described conventional technology, sheets or the like such as mail sorted and received in sections of the stacker device must be taken out and returned to the feeder so as to perform carrier route sequencing. For this purpose, there are employed a recycle for shifting the sorted sheets or the like from the stacker to the feeder device. In this case, in order to supply the sorted mail in the stacker to the feeder again, the mail taken out of the stacker must be transferred about 3 to 6 m from the stacker to the feeder.

However, supposing the number of mail per deliverer is about 1000, the weight of the mail is totally about 10 kg, and consequently, for example, it is necessary to prepare trays for containing the mail in the vicinity of the stacker, to introduce the sorted mail into the trays carefully without changing the order of the mail, to carry the trays to the vicinity of the feeder device and to supply the mail to the feeder device successively in order. Such operations require much labor and time and involve a problem that if an error occurs in the order of the mail when moving the mail into or out of the trays, correct carrier route sequencing can not be carried out.

SUMMARY OF THE INVENTION

An object of the present invention is to provide an apparatus for sorting sheets or the like which can improve the efficiency of sequencing sorted mail into carrier route order.

In order to achieve the above object, one characteristic of the present invention resides in an apparatus for sorting sheets or the like, comprising: a feeder which hold a plurality of sheets or the like in standing positions; a separator (or singulator) for taking up (or singulating) the sheets or the like one by one from the feeder; an address code reader for reading address codes applied to the sheets or the like which have been taken up by the separator; a stacker provided on an upper portion of the feeder, the stacker including a plurality of stacking sections in which the sheets or the like are stacked in standing positions; a conveyer for the sheets or the like which connects the separator and the stacker; and a sheets or the like sorter for sorting the sheets or the like to any of the stacking sections of the stacker in accordance with the address codes which have been read by the address code reader.

In this case, preferably, the apparatus further includes a switch-back device for reversing the direction of conveyance of the sheets or the like, the switch-back device being provided in the middle of the conveyer.

Further, preferably, the address code reader consist of a first address code reader for reading address codes applied to the front surfaces of the sheets or the like which have been taken up by the separator, and a second address code reader for reading address codes applied to the back surfaces of the sheets or the like which have been taken up by the separator, and the sorter sorts the sheets or the like to any of the stacking sections of the stacker in accordance with the address codes which have been read by the first address code reader or the second address code reader.

Preferably, the stacker further includes sheets or the like shifter by which the sheet or the like held in substantially standing positions in the stacker are shifted into the feeder so as to be held in standing positions and moved to the separator without changing the order of the sheets or the like when they were shifted to the stacker.

Preferably, the stacker further includes bottom-surface mover which lets the sheets or the like in standing positions in the stacker fall down into the feeder. In this case, it is effective that the feeder include a sheet or the like moving device for moving the sheets or the like held in standing positions in the feeder, toward the separator.

Preferably, the feeder which holds the sheets or the like in standing positions are replaced with a feeder which holds a plurality of sheets or the like in standing or horizontal positions, and the stacker in which the sheets or the like are stacked in standing positions are replaced with a stacker including a plurality of stacking sections in which the sheets or the like are stacked in standing or horizontal positions, and also, the stacker includes a bottom-surface mover which lets the sheets or the like in the stacker fall down into the feeder, and the feeder includes a bottom-surface mover for raising the bottom surface thereof toward the bottom surface of the stacker and returning it to the original position.

It is effective that the stacker includes a first stacker including a plurality of stacker sections in which the sheet or the like are stacked in standing positions, which first stacking device can shift the sheet or the like to the feeder, and the sheets or the like sorter includes a first sheets or the like sorter, and the apparatus further includes a second distributor for distributing the sheets or the like to the second stacker. In this case, preferably, the plurality of processing segments are such that the number of the sheets or the like belonging to each of the processing segments is not more than the number which can be placed in the feeder at one time.

With this structure, it is effective that the apparatus further includes a thickness measurer for measuring the thickness of the sheets or the like; a first storage unit for storing the thickness of the sheets or the like which have been measured by the thickness measurer and the address codes of the sheets or the like which have been read by the address code reader; a sequencer for sequencing the address codes and the thickness of the sheets or the like in the first storage unit into the serial order of the address codes; a second storage unit for storing the address codes and the thickness of the sheets or the like produced from the sequencer, in the serial order of the address codes; and a controller by which when the total thickness of the sheets or the like is larger than the thickness which can be placed in the feeder at one time, the address codes stored in the second storage unit are divided into a plurality of continuous processing segments, a plurality of the sheets or the like supplied to the feeder are taken up one by one by the separator, the address codes are read by the address code reader, and sheets or the like whose read address codes are not in the first one of the processing segments, are stacked in the second stacker. In this case, preferably, the total thickness of the sheets or the like belonging to each of the processing segments is not more than the thickness which can be placed in the feeder at one time.

With the structure having the first and second distributor it is effective that the apparatus further includes a thickness measurer for measuring the thickness of the sheets or the like; a first storage unit for storing the thickness of the sheets or the like which have been measured by the thickness measurer and the address codes of the sheets or the like which have been read by the address code reader; a sequencer for sequencing the address codes and the thickness of the sheets or the like in the first storage unit into the serial order of the address codes; a second storage unit for storing the address codes and the thickness of the sheets or the like produced from the sequence in the serial order of the address codes; a third storage unit for storing correspondence between the stacker sections of the first stacker and digits in any of the positions which constitute the address codes; and a controller by which when the total thickness of the sheets or the like inputted from the second storage unit is larger than the thickness which can be placed in the feeder at one time, the address codes are divided into a plurality of processing segments, provided with processing segment symbols and stored in the second storaged unit, a plurality of the sheets or the like supplied to the feeder are taken up one by one by the separator, the address codes are read by the address code reader, and sheets or the like whose read address codes are not in the first one of the processing segments are stacked in the second stacker, the thickness of the sheets or the like corresponding to the address codes having a common digit in any of a plurality of positions of the address codes is summed up, and when the total thickness of the sheets or the like is larger than the thickness which can be stacked in each of the stacking sections, common sorting information is allotted to two continuous stacking sections and stored in the third storage unit.

Similarly, with the structure having the first and second distributor, it is preferred that the apparatus further includes a thickness measurer for measuring the thickness of the sheets or the like; a first storage unit for storing the thickness of the sheets or the like which have been measured by the thickness measurer and the address codes of the sheets or the like which have been read by the address code reader; a sequencer for sequencing the address codes and the thickness of the sheets or the like in the first storage unit into the serial order of the address codes; a second storage unit for storing the address codes and the thickness of the sheets or the like produced from the sequencer, in the serial order of the address codes; and a controller by which address codes of sheets or the like to be delivered with priority are obtained in advance, a plurality of the sheets or the like supplied to the feeder are taken up one by one by the separator, the address codes are read by the address code reader, and sheets or the like whose read address codes are not the address codes for sorting with priority are received in the second stacker.

It is effective that the stacker are devices including a plurality of stacking sections in which the sheets or the like are stacked in standing positions, which a stacker can shift the sheets or the like to the feeder, and the apparatus further includes for displaying, for each of the stacking sections, a range of the address codes of the sheets or the like stacked in the stacking section when sequencing of the sheets or the like is completed.

Further, it is effective that the stacker are devices including a plurality of stacking sections in which the sheets or the like are stacked in standing positions, which stacker can shift the sheets or the like to the feeder and the apparatus further includes display devices which correspond to the respective stacking sections and are provided in the vicinity of the stacking sections, each of which displayer displays address codes of sheets or the like stacked in the nearest adjacent stacking section when sequencing of the sheets or the like is completed.

Moreover, it is effective that the stacker device are devices including a plurality of stacking sections in which the sheets or the like are stacked in standing positions, which a stacker device can shift the sheets or the like to the feeder device and the apparatus further includes control devices by which the stacking sections of the stacker devices are associated with digits in a predetermined position of the address codes in normal order or reverse order, a plurality of the sheets or the like supplied to the feeder device are taken up one by one by the separator device and are distributed to the stacking sections of the stacker device in accordance with the address codes read by the address code reader device, the sheets or the like are shifted from the stacker devices to the feeder devices so as to be fed to the separator devices again, and a series of the foregoing operations are repeated and controlled. In this case, preferably, the apparatus further includes control devices by which the series of operations starts with associating digits in the first position from the right of a plurality of positions of the address codes in normal order or reverse order, with the respective stacking sections of the stacker devices and every time the series of operations is repeated, digits in the next position of the address codes to the left of the former position are associated with the respective stacking sections of the stacker devices and the order of the digits in the position of the address codes corresponding to the stacking sections is reversed, and the series of operations is repeated as many times as the number of digit positions of the address codes so that a plurality of the sheets or the like discriminated by the address codes can be sequenced into normal order or reverse order of the address codes.

Another characteristic of the present invention resides in an apparatus for sorting sheets or the like, comprising: feeder devices which hold a plurality of sheets or the like; separator devices for taking up the sheets on the like one by one from the feeder device address code a reading device for reading address codes applied to the sheets or the like which have been taken up by the separator device; stacker devices provided on an upper portion of the feeder devices, the stacker devices including a plurality of stacking sections in which the sheets or the like are stacked; conveyer for the sheets or the like which connect the separator devices and the stacker devices; sheet or the like distributor devices for distributing the sheet or the like to any of the stacking sections of the stacker devices in accordance with the address codes which have been read by the address code reader devices and a shift device for shifting the sheets or the like in the stacker devices to the feeder devices, the shift devices being provided between the stacker devices and the feeder devices.

Since the stacking unit is provided on the upper portion of the feeder devices, the sheets or the like sorted to the stacking sections of the stacker device can be shifted from the stacking unit on an upper shelf to the feeder devices on a lower shelf when the sheets or the like are supplied to the feeder devices again. As a result, the operational efficiency of the carrier route sequencing can be improved.

In this specification of the invention, in the feeder device are accumulated. The separator devices are a mechanism consisting of a rotating belt for taking up letters one by one from the feeder devices and conveying it. The first address code reader devices and the second address code reader devices are mechanisms for reading bar codes or the like, such as bar code readers and OCR devices. The first stacker devices are a box structure divided by a plurality of partitions and consist of a plurality of stacking sections. The letters which have been conveyed by the belt are distributed to the stacking sections in accordance with their addresses. The second stacker devices are a mechanism similar to the first stacker device and letters rejected by the first stacker devices are stacked in the second stacker devices. The devices are, for example, a belt. The switch-back devices reverse the advancing direction of letters. The sheet or the like distributor devices are switch devices for the advancing direction of the letters.

According to the present invention, the sheets or the like to which address codes are applied, such as mail, can be sequenced into the order indicated by the address codes, and the efficiency of such carrier route sorting operation can be improved.

DETAILED DESCRIPTION OF THE INVENTION

The preferred embodiments of the present invention will be hereinafter described with reference to the attached drawings.

Figure 1:
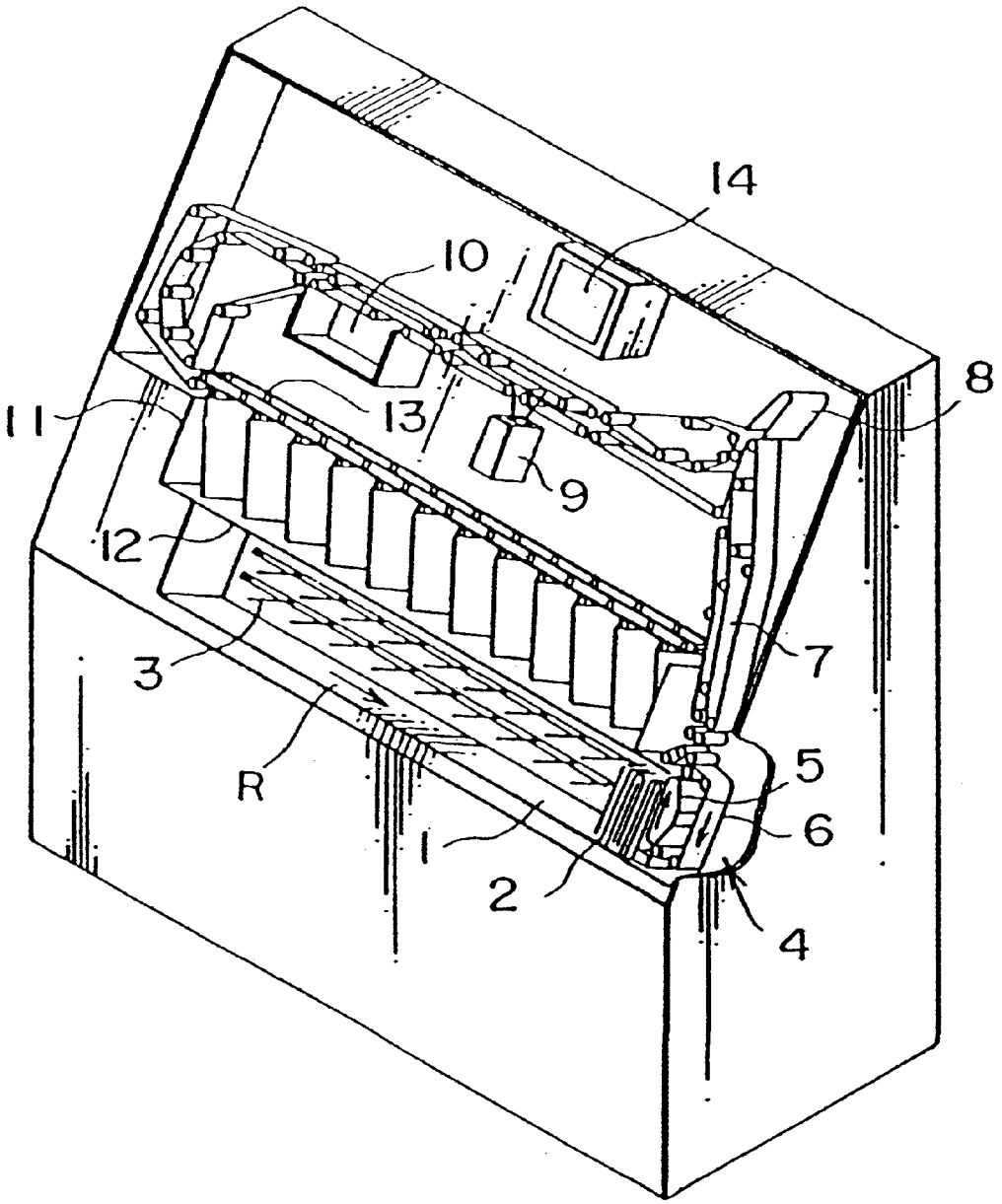
FIG. 1 is a perspective view showing one embodiment of an apparatus for sorting sheets or the like according to the present invention.

FIG. 1 is a perspective view showing one embodiment of an apparatus for sorting sheets or the like according to the invention. In FIG. 1, reference numeral 1 denotes feeder devices which can hold a plurality of sheets or the like 2 in standing positions, and 3 denotes forks which are supported along the feeder devices 1 so as to move in a direction indicated by the arrow R. The forks 3 can move the sheets or the like 2 in the direction of the arrow R while pressing the sheets or the like 2.

Reference numeral 4 denotes separator devices which can take up only the right-end one of the sheet or the like 2 placed on the feeder devices 1 and convey it upwardly. Such sheet or the like separator devices are generally of the suction type with a vacuum suction belt. A vacuum chamber 5 is maintained under a negative pressure to suck and attach each sheet or the like 2 to a suction belt 6, and the suction belt 6 is rotated by drive devices such as a motor, so that only the right-end one of the sheets or the like 2 can be separated and conveyed upwardly.

Reference numeral 7 denotes a conveyer passage in which the sheets or the like 2 can be conveyed. In the conveyer passage 7, for example, the front and back surfaces of each sheet or the like 2 taken up by the separator devices 4 are held between belts and conveyed. Reference numeral 8 denotes a or reversing device provided in the conveyer passage 7, whereby the advancing direction of the sheets or the like 2 is reversed.

Reference numeral 9 denotes first address code reader devices which read address codes, e.g., bar codes, applied to the sheets or the like 2 beforehand.

Reference numeral 10 denotes a sheets or the like discharge portion. The sheets or the like 2 whose address codes were unreadable, the sheets or the like 2 whose address codes were erroneously read, and the sheets or the like 2 which were judged to be unsuitable for conveyance, are discharged from the conveyer passage 7 and stacked in the sheets or the like discharge portion 10.

Reference numeral 11 denotes first stacker devices in which the sheets or the like 2 after reading are stacked. The first stacker devices 11 are provided closely above the feeder devices 1. The inside space of the first stacker devices 11 is partitioned into stacking sections, e.g., S1 to S12, in each of which the sheets or the like 2 can be held in substantially standing positions. Reference numeral 12 denotes a bottom plate of the first stacker devices 11.

Reference numeral 13 denotes first distributor devices which distribute the sheets or the like 2 to the stacking sections of the first stacker devices 11 in accordance with the address codes read by the address code reader devices 9. Reference numeral 14 denotes a display device for displaying information about address codes and so forth.

Figure 2:
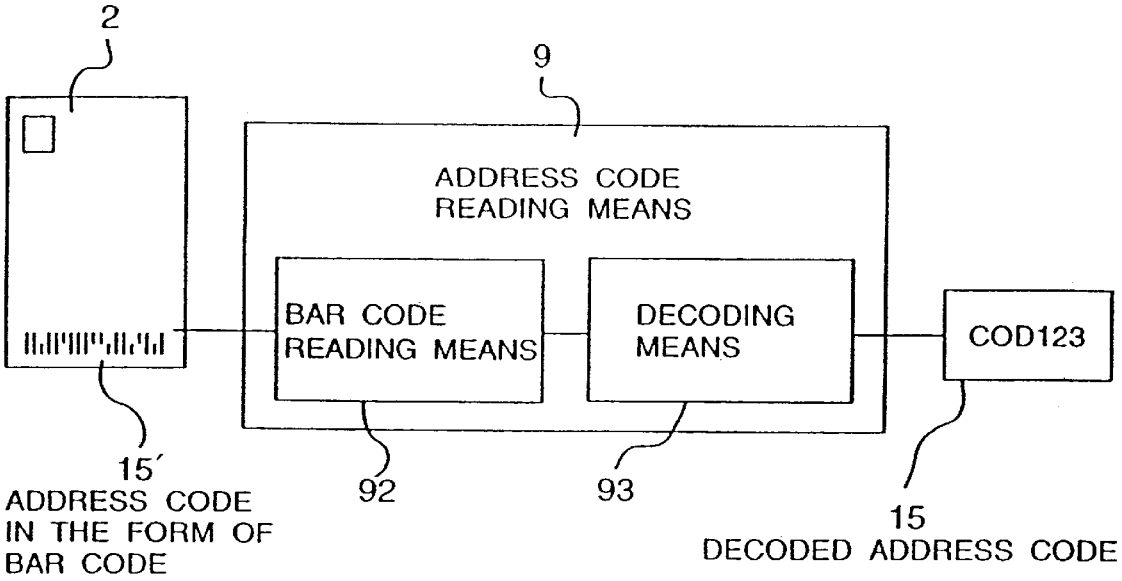
FIG. 2 is a diagram showing an address code and one example of the structure of address code reader devices which constitute the sheet or the like sorting apparatus of the invention.

FIG. 2 is a diagram showing an address code applied to a sheet or the like beforehand, and one example of the structure of the address code reader devices 9 according to the present invention. In FIG. 2, reference numeral 15' denotes the address code applied to the sheet or the like 2 in the form of, e.g., a bar code which can represent numerals and symbols by the length of the bars. Reference numeral 92 denotes bar code reader devices provided inside of the address code reader device 9. The and the bar code reader devices 92 can read the address code 15' in the form of a bar code. Reference numeral and 93 denotes decoding devices which can decode the address code 15' which has been read by the bar code reader devices 92, into the original numerals and symbols, and 15 denotes the decoded address code expressed by the original numerals and symbols.

Figure 3:
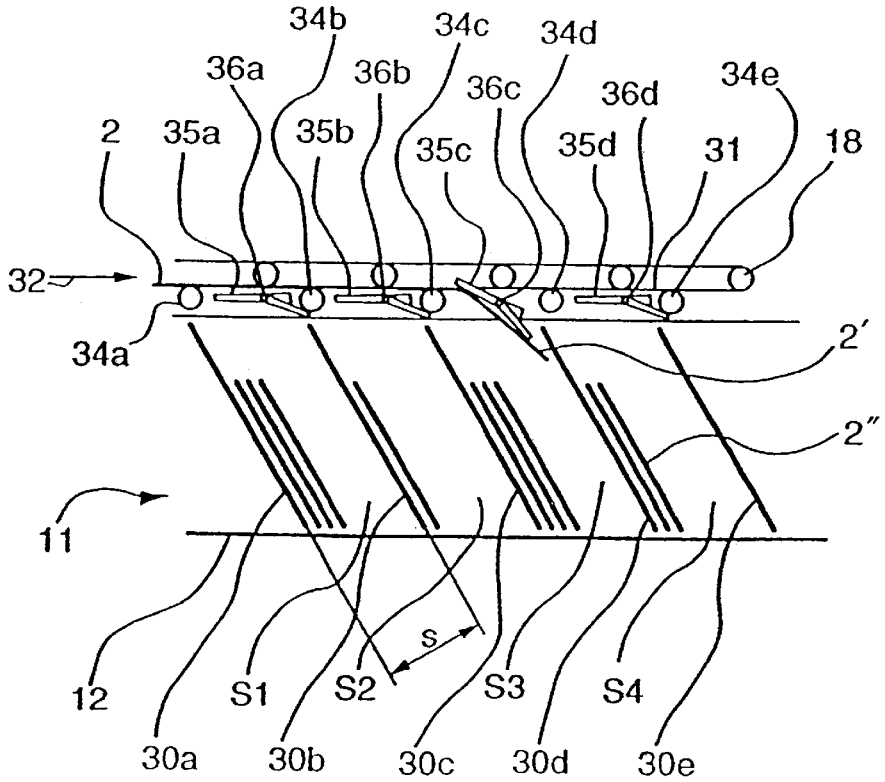
FIG. 3 is a front view showing one example of the structure of first stacker device and first distributor device which constitute the sheet or the like sorting apparatus of the invention.

FIG. 3 is a front view showing one example of the structure of the first stacker devices 11 and the first distributor devices 13 according to the invention. In FIG. 3, reference numerals 30*a*, 30*b*, 30*c* . . . denote partitions which define stacking sections S1, S2, S3 . . . of the first stacker devices 11. Reference numeral 31 denotes a belt for conveying sheets or the like 2, which constitutes one portion of the conveyer passage 7, and the belt 31 moves in a direction indicated by the arrow 32. Reference numeral 18 denotes pulleys for driving the belt 31, and 34 denote rollers for holding the sheets or the like 2 against the belt 31.

Reference numerals 35 denote gate diverters whereby the sheets or the like 2 which have been held between the belt 31 and the rollers 34 and conveyed in a direction of arrow 32 are sorted to the stacking sections S1, S2, S3 . . . Each of the gate diverters 35 can pivotally move for a predetermined angle around a pivot axis 36. For example, when gate diverters 35*a*, 35*b* extend substantially in parallel to the belt 31, each sheet or the like 2 is passed between the gate diverters 35*a*, 35*b* and the belt 31 and conveyed to a gate diverter 35*c*. Then, the gate diverter 35*c* is pivotally moved for the predetermined angle around a pivot axis 36*c* so that the upper end of the gate diverter 35*c* becomes closer to the associated pulley 18 than the belt 31. In consequence, as shown by a sheet or the like 2', the sheet or the like 2' is passed below the gate diverter 35*c* and introduced into a stacking section 11*c*. By providing as many such structures as the number of stacking sections in the longitudinal direction of the first stacker devices 11, the first stacker devices 11 can be partitioned into, e.g., 12 stacking sections. Sheets or the like 2" distributed to the stacking sections lean against the partitions 30 between the stacking sections S1 to S12 and are stacked in substantially standing positions though slightly inclined.

Next, one example of the structure of the feeder devices 1, the first stacker devices 11, the conveyer devices 7, the switch-back portion 8 and the reader devices corresponding to the procedures from the feeder devices 1 to the first stacker devices 11 will be described with reference to FIGS. 4 to 8. FIGS. 4 to 8 are simplified views showing the structures of the preferred embodiments of the sheet or the like sorting apparatus according to the present invention. In these drawings, the conveyer devices 7 are expressed by the solid line which only indicates the conveyance course of sheets or the like 2.

Figure 4:
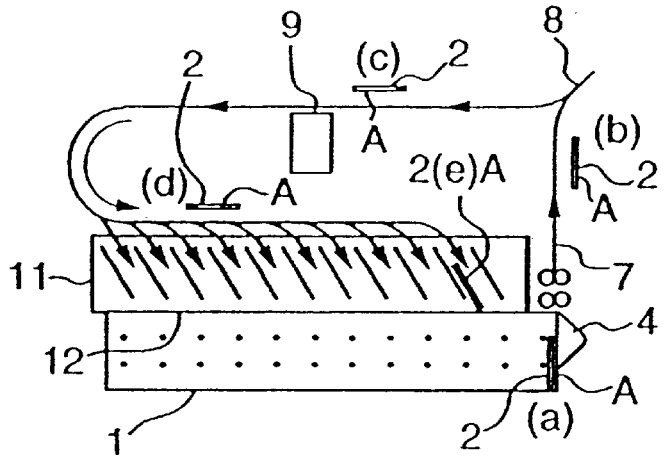
FIG. 4 is a simplified view showing the structure of one embodiment of the sheet or the like sorting apparatus of the invention.

FIG. 4 shows a first embodiment including the switch-back portion 8 and the first address code reading portion 9.

One end of a sheet or the like 2 is blackened to indicate its leading end. The surface of the sheet or the like 2 on which an address code 15 is printed is denoted by reference symbol A and assumed to face the separator devices 4. The sheets or the like 2 held in standing positions by the feeder devices 1 (state a) are separated and conveyed upwardly one by one by the separator devices 4, and then each sheet or the like 2 is passed to the conveyer devices 7 (state b). During the conveyance, the sheet or the like 2 enters the switch-back portion, 8 where its direction of conveyance is reversed, and the sheets or the like is passed to the conveyer devices 7 from the end which has originally been the trailing end of the sheet or the like 2 (state c). Then, the address code 15 is read by the address code reader devices 9. At this time, the surface A faces downwardly, and the address code reader devices 9 located below the conveyer devices 7 read the address code 15 from the lower side of the sheet or the like 2.

After that, the sheet or the like 2 is conveyed in a state d, and stacked in one of the stacking sections of the first stacker devices 11 in accordance with the contents of the address code 15 printed on the surface A of the sheet or the like 2, thus completing a series of sorting operations. At this time, the sheet or the like 2 is in a state e which is similar to the state a when the sheet or the like 2 is held in the standing position by the feeder devices 1. If the sheet or the like 2 in the first stacker devices 11 is shifted to the feeder devices 1 and fed to the separator devices 4 again, sorting operations of the sheet or the like 2 can be repeated.

Figure 5:
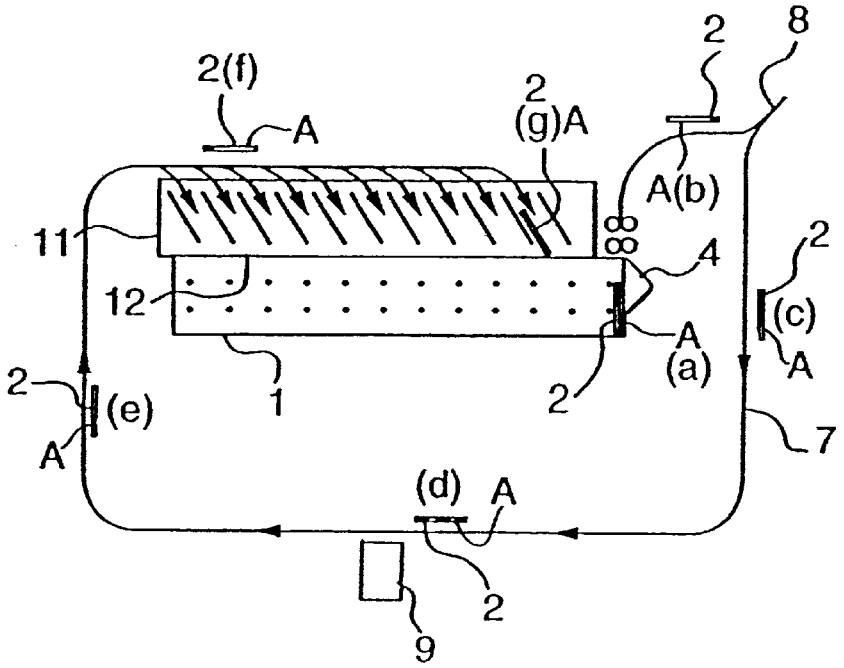
FIG. 5 is a simplified view showing the structure of another embodiment of the sheet or the like sorting apparatus of the invention.

FIG. 5 shows a second embodiment including the switch-back portion 8 and the first address code reading portion 9. This embodiment is different from the first embodiment shown in FIG. 4 in that the conveyer devices 7 extend below the feeder devices 1. In this case as well, a state a of a sheet or the like 2 when it is held in the standing position by the feeder devices 1 is similar to a state g of the sheet or the like 2 which is stacked in one of the collecting sections of the first stacker devices 11 after being conveyed in the order of states b to f along the conveyer devices 7.

Therefore, if the sheet or the like 2 in the first stacker devices 11 is shifted to the feeder devices 1 and fed to the separator devices 4 again, sorting operations of the sheet or the like 2 can be repeated.

Figure 6:
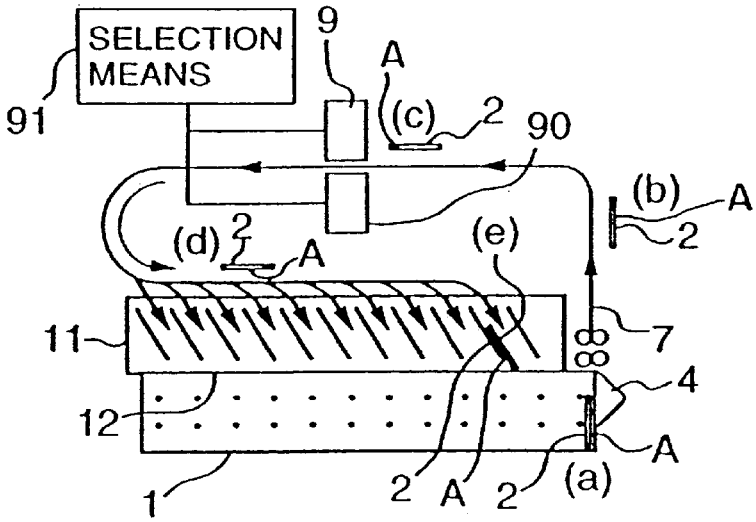
FIG. 6 is a simplified view showing the structure of a further embodiment of the sheet or the like sorting apparatus of the invention.

FIG. 6 shows a third embodiment of the present invention. This embodiment is different from the first embodiment in that it does not include the switch-back portion 8 but includes the first address code reading portion 9 which is provided above the conveyer devices 7 so as to read an address code 15 from the upper side of each sheet or the like 2, a second address code reading portion 90 which is provided below the conveyer devices 7 so as to read the address code 15 from the lower side of the sheet or the like 2, and selection devices 91 for selectively using either the first address code reading portion 9 or the second address ode reading portion 90.

The leading end of a sheet or the like 2 and the surface of the sheet or the like 2 on which the address code 15 is printed, are expressed in the same manner as the first embodiment. Sheets or the like 2 held in standing positions by the feeder devices 1 (state a) are separated and conveyed upwardly one by one by the separator devices 4, and then, each sheet or the like 2 is passed to the conveyer devices 7 (state b). Then, the address code 15 is read by the address code reader devices 9 when the sheet or the like 2 is in a state c. At this time, the surface A faces upwardly, and the first address code reader devices 9 read the address code 15. After that, the sheet or the like 2 is conveyed in a state d, and stacked in one of the stacking sections of the first stacker devices 11 in accordance with the contents of the address code 15 printed on the surface A of the sheet or the like 2, thus completing a series of sorting operations. At this time, the sheet or the like 2 is in a state e which is reverse to the state a when the sheet or the like 2 is held in the standing position by the feeder devices 1, so that the leading and trailing ends and the front and back surfaces of the sheet or the like 2 are reversed.

Consequently, if the sheet or the like 2 in the first stacker devices 11 is shifted to the feeder devices 1 and fed to the separator devices 4again so as to repeat sorting operations of the sheet or the like 2, the position of the sheet or the like 2 are reversed, and the surface A of the sheet or the like 2 on which the address code 15 is printed faces downwardly not toward the address code reader devices 9. Therefore, the address code 15 is read from the lower side of the sheet or the like 2 by the second address code reader devices 90.

With this arrangement, each time a series of sorting operations is repeated, either the first address code reader devices 9 or the second address code reader devices 90 is selected by the selection devices 91 so that sorting operations of the sheet or the like 2 can be repeated.

Figure 7:
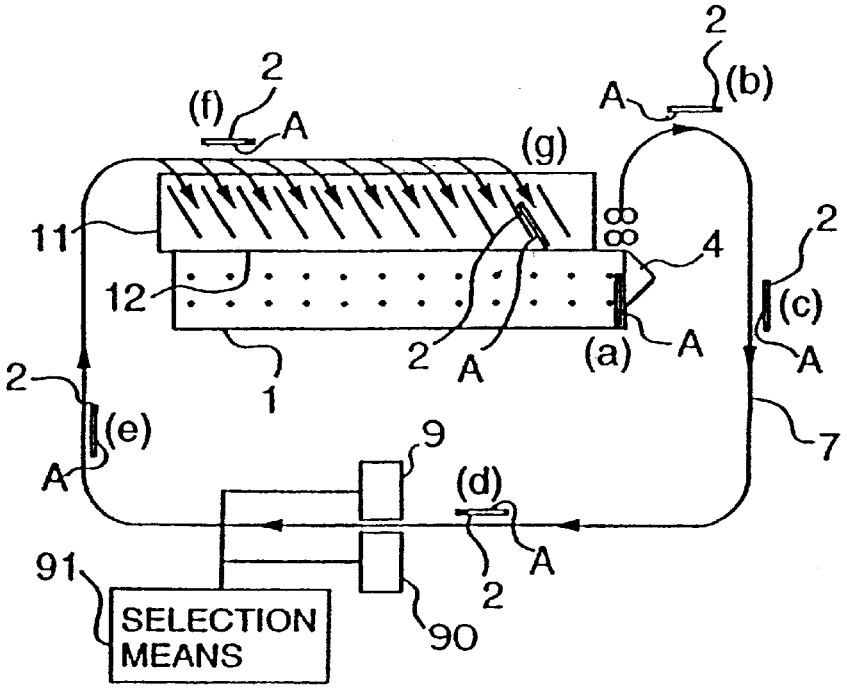
FIG. 7 is a simplified view showing the structure of another embodiment of the sheet or the like sorting apparatus of the invention.

FIG. 7 shows a fourth embodiment of the present invention. This embodiment is different from the third embodiment in that the conveyer devices 7 extend below the feeder devices 1. In this case as well, a state a of each sheet or the like 2 when it is held in the standing position by the feeder devices 1 is reverse to a state g of the sheet or the like 2 which is stacker in one of the stacking sections of the first stacking devices 11 after being conveyed in the order of states b to f along the conveyer devices 7, so that the leading and trailing ends and the front and back surfaces of the sheet or the like 2 are reversed.

Therefore, each time a series of sorting operations is repeated, either the first address code reader devices 9 or the second address code reader devices 90 is selected by the selection devices 91 so that sorting operations of the sheet or the like 2 can be repeated.

In the embodiments shown in FIGS. 6 and 7, even if the front surfaces of the sheets or the like 2 supplied to the feeder devices 1 face different directions, the address codes 15 applied to the sheets or the like 2 can be read by either the first reader devices 9 or the second reader devices 90. Consequently, when the sheets or the like 2 are supplied to the feeder devices 1, the front surfaces of the sheets or the like 2 need not be arranged to face the same direction.

Figure 8:
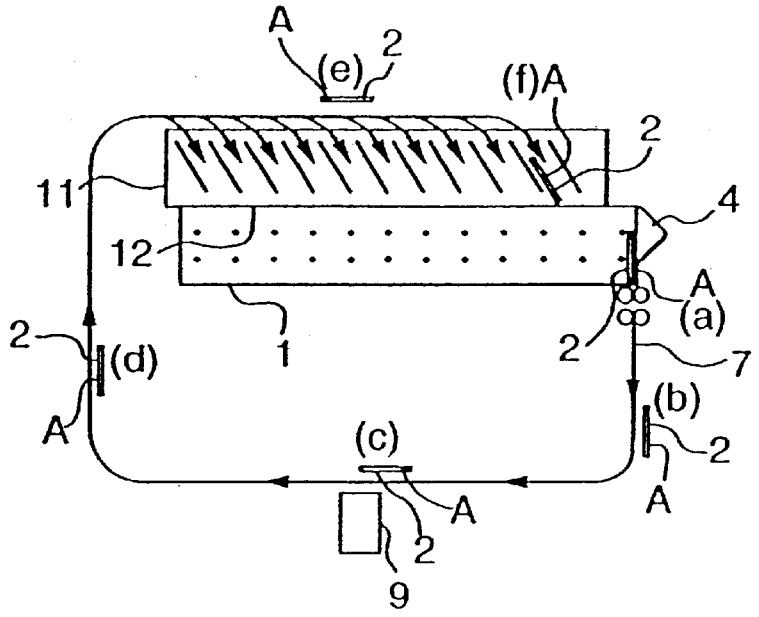
FIG. 8 is a simplified view showing the structure of a further embodiment of the sheet or the like sorting apparatus of the invention.

FIG. 8 shows a fifth embodiment of the invention. This embodiment is different from the first to fourth embodiments in that each sheet or the like 2 separated by the separator device 4 is conveyed downwardly. The fifth embodiment does not include the switch-back portion 8, the second address code reader devices 90 and the selection devices 91. In the fifth embodiment, a state a of the sheet or the like 2 when it is held in the standing position by the feeder devices 1 is similar to a state f of the sheet or the like 2 which is stacked in one of the stacking sections of the first stacker devices 11 after conveyed in the order of states b to e along the conveyer devices 7.

Therefore, if the sheet or the like 2 in the first stacker devices 11 is shifted to the feeder devices 1 and fed to the separator devices 4 again, sorting operations of the sheet or the like 2 can be repeated.

Next, the process of sequencing operation of sheets or the like 2 (sorting operation in accordance with their carrier route) with the structure of the preferred embodiment of the present invention will be described. FIGS. 9 to 15 are diagrams showing one example of carrier route sequencing operation of sheets or the like 2 in the sheet or the like sorting apparatus according to the invention. The following explanation will be given on the basis of the structure of the first embodiment of the invention shown in FIG. 4. However, the second to fifth embodiments of the invention can be likewise provided although the configuration of the conveyer devices 7 from the feeder devices 1 to the stacker devices 11 and the direction of the front surfaces of the sheets or the like 2 are different.

For the explanation, the contents of address codes 15 are represented by numerals in three digits from 000 to 999, and expressed as COD000 to COD999 to discriminate them from other numerals. This embodiment relates to the operation of sequencing 1000 sheets or the like 2 to which address codes 15 of COD000 to COD999 are applied at random, in accordance with the serial order of the address codes 15 (carrier route sequencing operation). In order to simplify the explanation, the number of sheets or the like 2 is set at a value such that the sheets or the like 2 can be introduced into feeder devices 1 at one time, and the sheets or the like 2 distributed to each stacking section of stacker devices 11 are assumed not to exceed the capacity of the stacking section. In the following explanation, operations of the component parts will not be described in detail, and orders of the address codes 15 in the process of sequencing of the sheets or the like 2 will only be described.

In FIGS. 9 to 15, conveyer devices 7 of the sheets or the like 2 are schematically indicated simply by a solid line or a dashed line for the explanation. When the conveyer devices 7 are indicated by a dashed line, it means that the sheets or the like 2 are not present on the conveyer devices 7.

The first stacker devices 11 are divided into 10 stacking sections corresponding to digits 0 to 9. The conveyed sheets or the like 2 are sorted to the stacking sections in accordance with their address codes 15.

Figure 9:
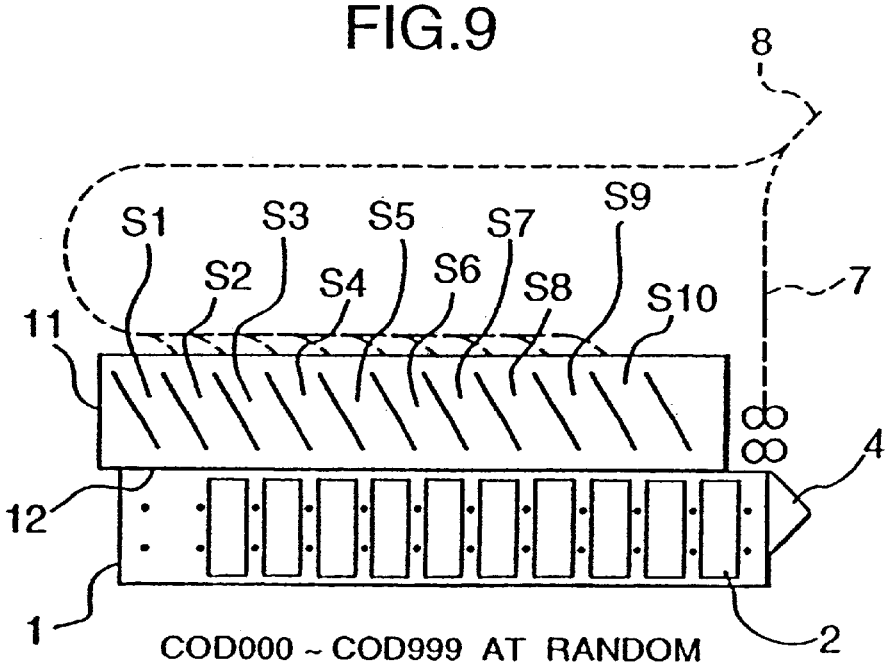
FIG. 9 is a diagram for explaining one example of sequencing operation of sheet or the like in their carrier route order in the sheet or the like sorting apparatus according to the invention.

Referring to FIG. 9, for example, 1000 sheets or the like 2 to which address codes 15 in three digits COD000 to COD999 are applied are provided in the feeder devices 1, and the order of the sheets or the like 2 is random. A sheet or the like 2 on the right end abuts against separator devices 4. When, for example, a vacuum suction belt 6, of the separator devices 4 is rotated, only one sheet or the like 2 on the right end is separated and conveyed upwardly.

The conveyed sheet or the like 2 is fed to first address code reader devices 9 which read an address code 15, i.e., one of the numerals COD000 to COD999 in this embodiment, applied to the sheet or the like 2 beforehand.

Figure 10:
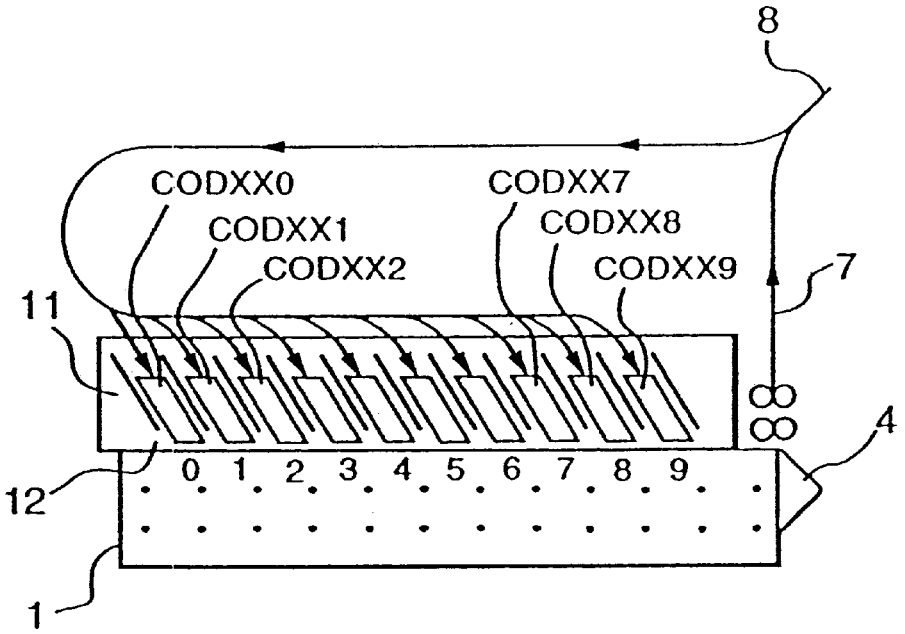
FIG. 10 is a diagram for explaining another example of carrier order sequencing operation in the sheet or the like sorting apparatus according to the invention.

Referring now to FIG. 10, the stacking sections S1 to S10 of the first stacker devices 11 are associated with digits 0 to 9 in this order. Each sheet or the like 2 whose address code 15 has been read by the first address code reader devices 9 is sorted to one of the stacking sections S1 to S10 corresponding to a digit in the first position from the right, i.e., the units digit, of the address code 15.

When all the sheets or the like 2 are similarly sorted to the stacking sections S1 to S10 corresponding to the units digits of the address codes 15, sheets or the like 2 having the same units digit are stacked in each of the stacking sections S1 to S10. In FIG. 10, an address code CODXX0 indicates that there are stacked sheets or the like 2 whose units digits are all 0 but whose tens and hundreds digits are randomly 0 to 9.

Next, all the sheets or the like 2 are moved into the feeder devices 1 without changing the order in which they were stacked in all the stacking sections S1 to S10 of the first stacker devices 11.

Figure 11:
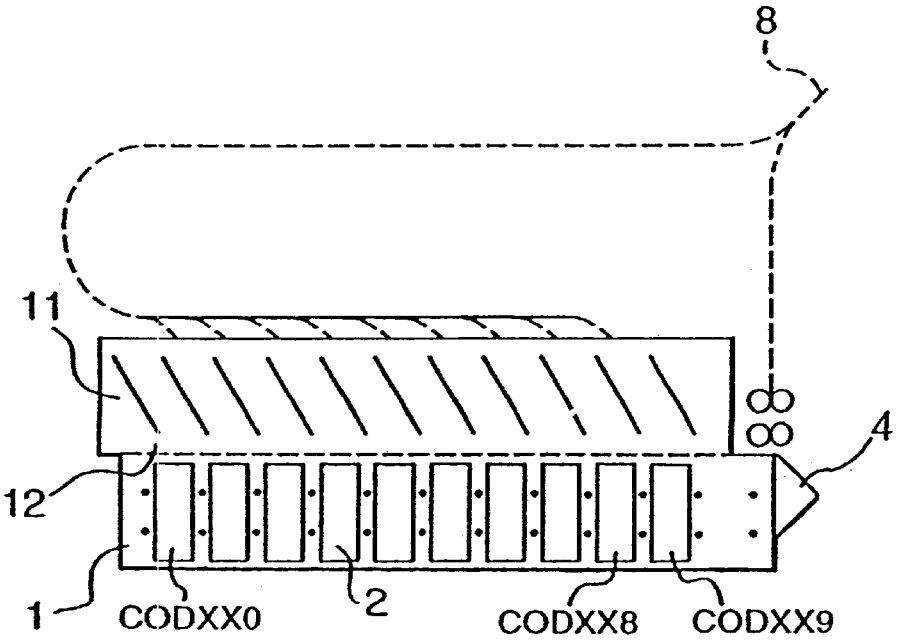
FIG. 11 is a diagram for explaining a further example of carrier order sequencing operation in the sheet or the like sorting apparatus according to the invention.

The state of the sheets or the like 2 after they have been moved is shown in FIG. 11. When the sheets or the like 2 in the feeder device 1 in this state are fed to the separator devices 4, only one sheet or the like 2 on the right end can be separated and conveyed upwardly again.

Figure 12:
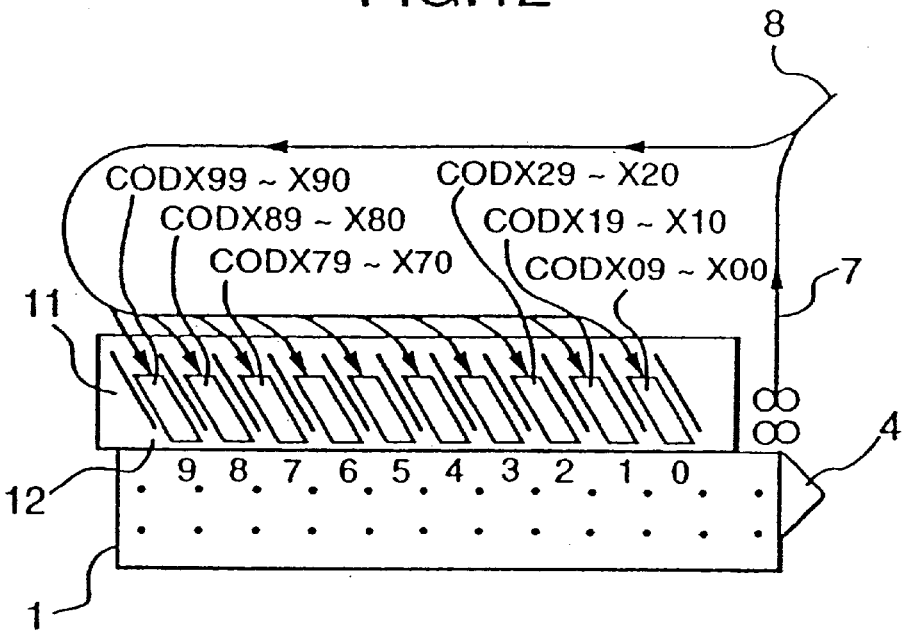
FIG. 12 is a diagram for explaining another example of carrier order sequencing operation in the sheet or the like sorting apparatus according to the invention.

FIG. 12 shows distribution in accordance with digits in the second position from the right, i.e., the tens digits, of the address codes 15. In FIG. 12, the stacking sections S1 to S10 of the first stacker devices 11 are associated with digits 9 to 0 in the order reverse to that shown in FIG. 10. As shown in FIG. 11, sheets or the like 2 whose units digits are all 9 are first fed to the separator devices 4. Then, each sheet or the like 2 whose address code 15 has been read by the first address code reader devices 9 is sorted to one of the stacking sections S1 to S10 corresponding to the tens digit of the address code 15. Similarly, the sheets or the like 2 whose units digits are 8 to 0 are successively sorted to the stacking sections S1 to S10 corresponding to digits in the middle position, i.e., the tens digits of the address codes 15.

As a result, in the stacking section S1, sheets or the like 2 whose hundreds digits are random but whose digits in the right two positions are 99 are stacked on the left end, and sheets or the like 2 whose hundreds digits are random but whose digits in the right two positions are 98 are stacked on the right side of this pile, and further, sheets or the like 2 whose hundreds digits are at random but whose digits in the right two positions are 97 are stacked on the right side of the second pile. By repeating this operation, sheets or the like 2 whose hundreds digits are random but whose digits in the right two positions are 90 are eventually stacked on the right end of the stacking section S1. In the stacking section S2, sheets or the like 2 whose hundreds digits are random but whose digits in the right two positions are 89 are stacked on the left end, and sheets or the like 2 whose hundreds digits are random but whose digits in the right two positions are 88 are stacked on the right side of this pile, and further, sheets or the like 2 whose hundreds digits are random but whose digits in the right two positions are 87 are stacked on the right side of the second pile. By repeating this operation, sheets or the like 2 whose hundreds digits are random but whose digits in the right two positions are 80 are eventually stacked on the right end of the stacking section S2. Likewise, in the stacking section S10, sheets or the like 2 whose hundreds digits are random but whose digits in the right two positions are 09 are stacked on the left end, and sheets or the like 2 whose hundreds digits are random but whose digits in the right two positions are 08 are stacked on the right side of this pile, and further, sheets or the like 2 whose hundreds digits are random but whose digits in the right two positions are 07 are stacked on the right side of the second pile. By repeating this operation, sheets or the like 2 whose hundreds digits are random but whose digits in the right two positions are 00 are eventually stacked on the right end of the stacking section S10.

Figure 13:
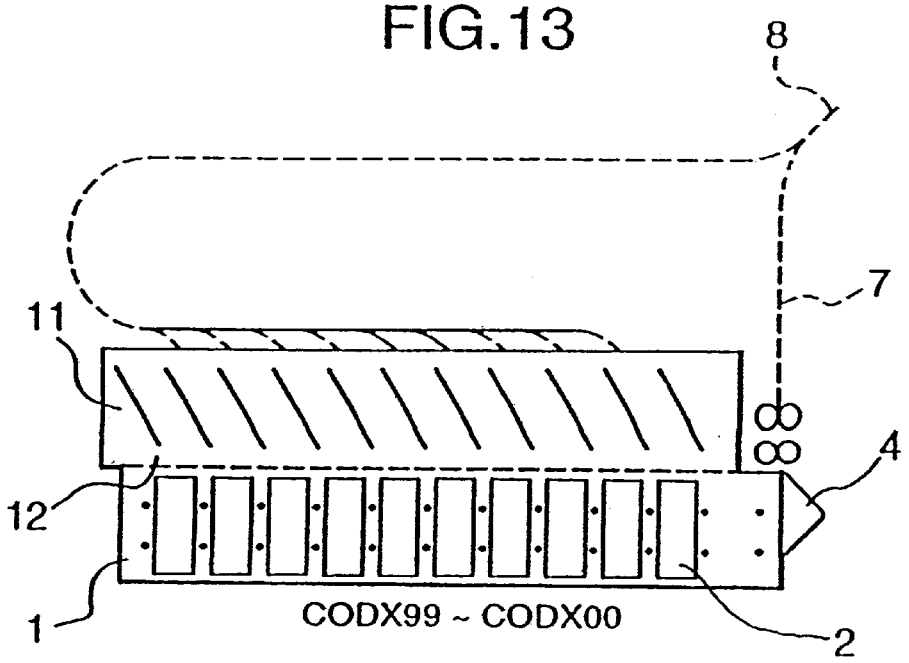
FIG. 13 is a diagram for explaining a further example of carrier order sequencing operation in the sheet or the like sorting apparatus according to the invention.

When the sheets or the like 2 stacked in the stacker devices 11 are again moved to the feeder devices 1, as shown in FIG. 13, the sheets or the like 2 are located in such an order that the sheets or the like 2 having 00 in the right two positions are on the right end, and that the sheets or the like 2 having 99 in the right two positions are on the left end.

Figure 14:
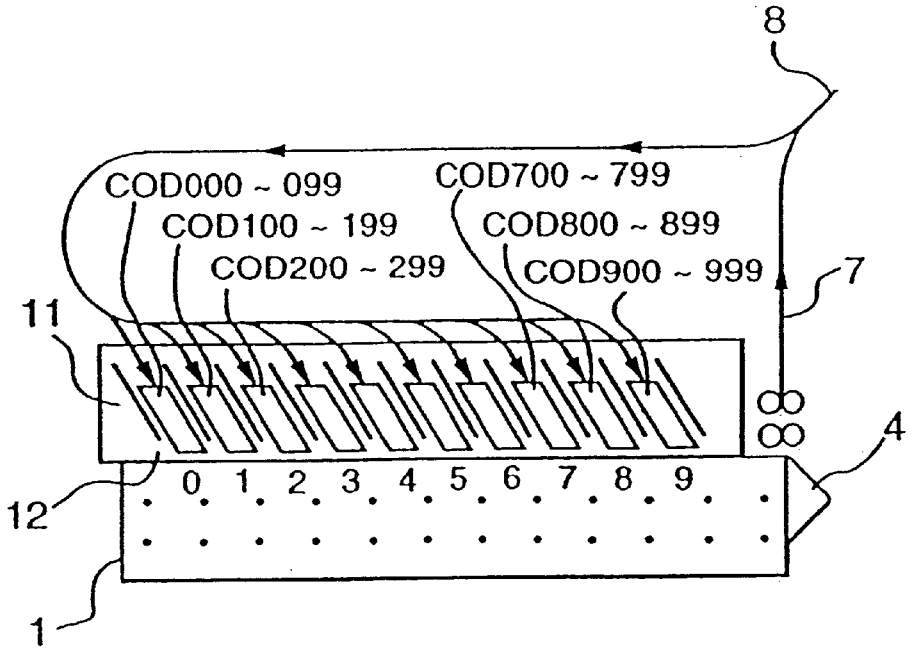
FIG. 14 is a diagram for explaining another example of carrier order sequencing operation in the sheet or the like sorting apparatus according to the invention.
Figure 15:
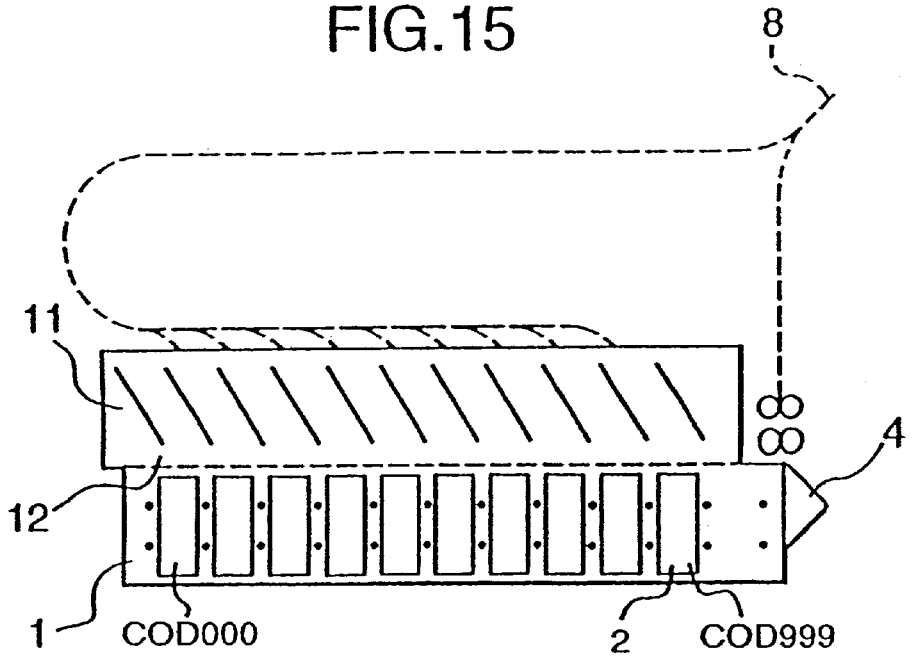
FIG. 15 is a diagram for explaining a further example of carrier order sequencing operation in the sheet or the like sorting apparatus according to the invention.

FIGS. 14 and 15 show distribution in accordance with digits in the third position from the right, i.e., the hundreds digits, of the address codes 15. In FIG. 14, the stacking sections S1 to S10 of the first stacker devices 11 are associated with digits 0 to 9 in the order reverse to that shown in FIG. 12. As shown in FIG. 13, sheets or the like 2 all of which have 00 in the right two positions are first fed to the separator devices 4. Then, each of the sheets or the like 2 whose address code 15 has been read by the first address code reader devices 9 is sorted to one of the stacking sections S1 to S10 corresponding to the hundreds digit of the address code 15. Similarly, sheets or the like 2 which have 01 to 99 in the right two sections are successively sorted to the stacking sections S1 to S10 corresponding to the hundreds digits of the address codes 15.

As a result, in the stacking section S1, a sheet or the like 2 of COD000 is stacked on the left end, and a sheet or the like 2 of COD001 is stacked on the right side of it, and further, a sheet or the like 2 of COD002 is stacked on the right side of the second one. By repeating operation, a sheet or the like 2 of COD099 is eventually stacked on the right end of the stacking section S1. In the stacking section S2, a sheet or the like 2 of COD100 is stacked on the left end, and a sheet or the like 2 of COD101 is stacked on the right side of it, and further, a sheet or the like 2 of COD102 is stacked on the right side of the second one. By repeating this operation, a sheet or the like 2 of COD199 is eventually stacked on the right end of the stacking section S2. Likewise, in the stacking section S10, a sheet or the like 2 of COD900 is stacked on the left end, and a sheet or the like 2 of COD901 is stacked on the right side of it, and further, a sheet or the like 2 of COD902 is stacked on the right side of the second one. By repeating this operation, a sheet or the like 2 of COD999 is eventually stacked on the right end of the stacking section S10.

As a result of the foregoing operations, all the sheets or the like 2 are sequenced in the serial order of the address codes 15 displayed on the sheets or the like 2, from the sheet or the like 2 of COD000 stacked on the left end of the stacker 11, to the sheet or the like 2 of COD999 stacked on the right end of the stacker devices 11.

In this embodiment, the sheets or the like 2 are sequenced in such a manner that the left-end one is COD000 and the right-end one is COD999. However, if the orders of digits corresponding to the stacking sections S1 to S10 in FIGS. 10, 12 and 14 are all reversed, the sheets or the like 2 can be sequenced in such a manner that the right-end one is COD000 and the left-end one is COD999.

Moreover, in this embodiment, 1000 codes from COD000 to COD999 are sequenced by repeating sorting to 10 stacking sections three times. However, the present invention is not limited to this embodiment. When the number of stacking sections is U and the number of repetition of sorting operations is n, it is possible to sequence $U^n$ codes.

The process of sequencing of the sheets or the like 2 in the serial order of the address codes 15 displayed on the sheets or the like 2 has been described above. In this embodiment, the number of the sheets or the like 2 does not exceed the capacity of the feeder devices 1 and the capacity of the stacker devices 11, and also, the number of the sheets or the like 2 in each of the stacking sections S1 to S10 does not exceed the capacity of the stacking section.

A sequencing device, for sequencing sheets or the like 2 when the number of the sheets or the like 2 exceeds the capacity of the feeder devices 1, will now be described.

Figure 16:
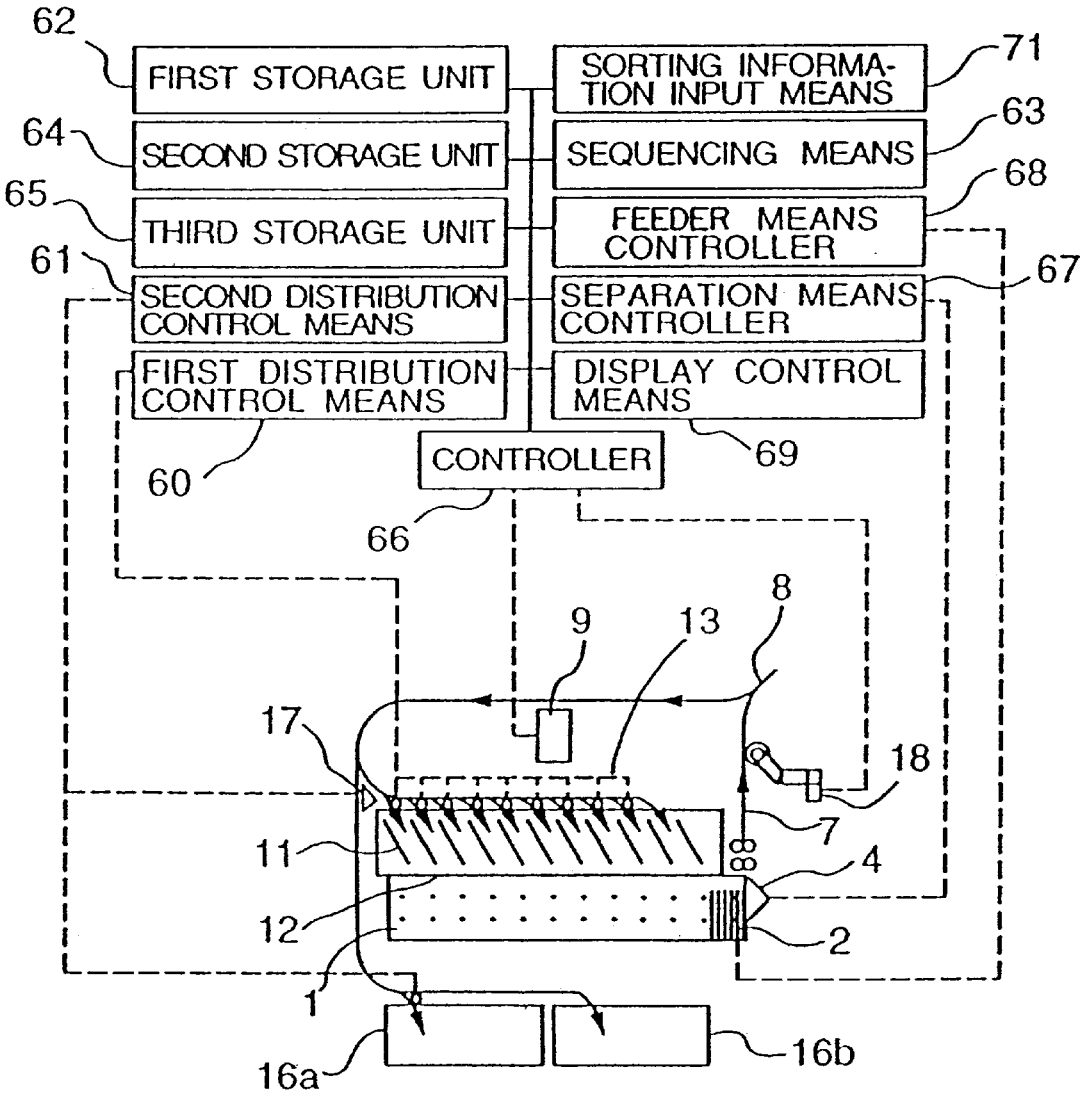
FIG. 16 is a block diagram showing the structure of one embodiment of a sheet or the like sorting apparatus according to the present invention.

FIG. 16 is a block diagram showing the structure of one embodiment of a sheets or the like sorting apparatus according to the present invention. In this embodiment, first stacker devices 11 which are partitioned into 12 stacking sections are employed as one example.

In FIG. 16, reference numerals 16 denote second stacker devices in which sheets or the like 2 can be stacked, 17 denotes second distributor devices for distributing the sheets or the like 2 to the second stacker devices 16, 18 denotes thickness detecting devices which can detect the thickness of each sheet or the like 2, 60 denotes first distribution control devices which can control the first distributor 13, 61 denotes second distribution control device which can control the second distributor devices 17, 62 denotes a first storage unit in which address codes 15 read by the address code reader devices 9 and thickness of the sheets or the like 2 determined by the thickness detecting devices 18 can be stored, 63 denotes sequencer devices for sequencing the address codes and the thickness in the serial order of the address codes 15, 64 denotes a second storage unit in which the address codes and the thickness sequenced by the sequencer devices 63 are stored and also processing segment information for dividing all the sheets or the like 2 into a plurality of processing segments for distributing them is stored, and 65 denotes a third storage unit in which the correspondence between digits in each position of the address codes to be distributed and the stacking sections of the first stacker devices 11 is stored.

Reference numeral 67 denotes a separator device controller which can control the separator device 4, 68 denotes a feeder devices controller which can control the feeder devices 1, 69 denotes display control devices which display predetermined information on the displayer devices 14, and 71 denotes sorting information input devices in which sorting information of the sheets or the like 2 in accordance with their carrier route can be inputted.

Reference numeral 66 denotes a controller which can control the thickness detecting devices 18, the address code reader devices 9, the first storage unit 62, the second storage unit 64, the third storage unit 65, the sequencer devices 63, the first distribution control devices 60, the second distribution control devices 61, the separator devices controller 67, the feeder devices controller 68, the display control devices 69 and the sorting information input devices 71.

Flow charts of FIGS. 17 to 20 and Tables 1 to 4 show the operation of the sheet or the like sorting apparatus according to this embodiment the present invention.

Figure 17:
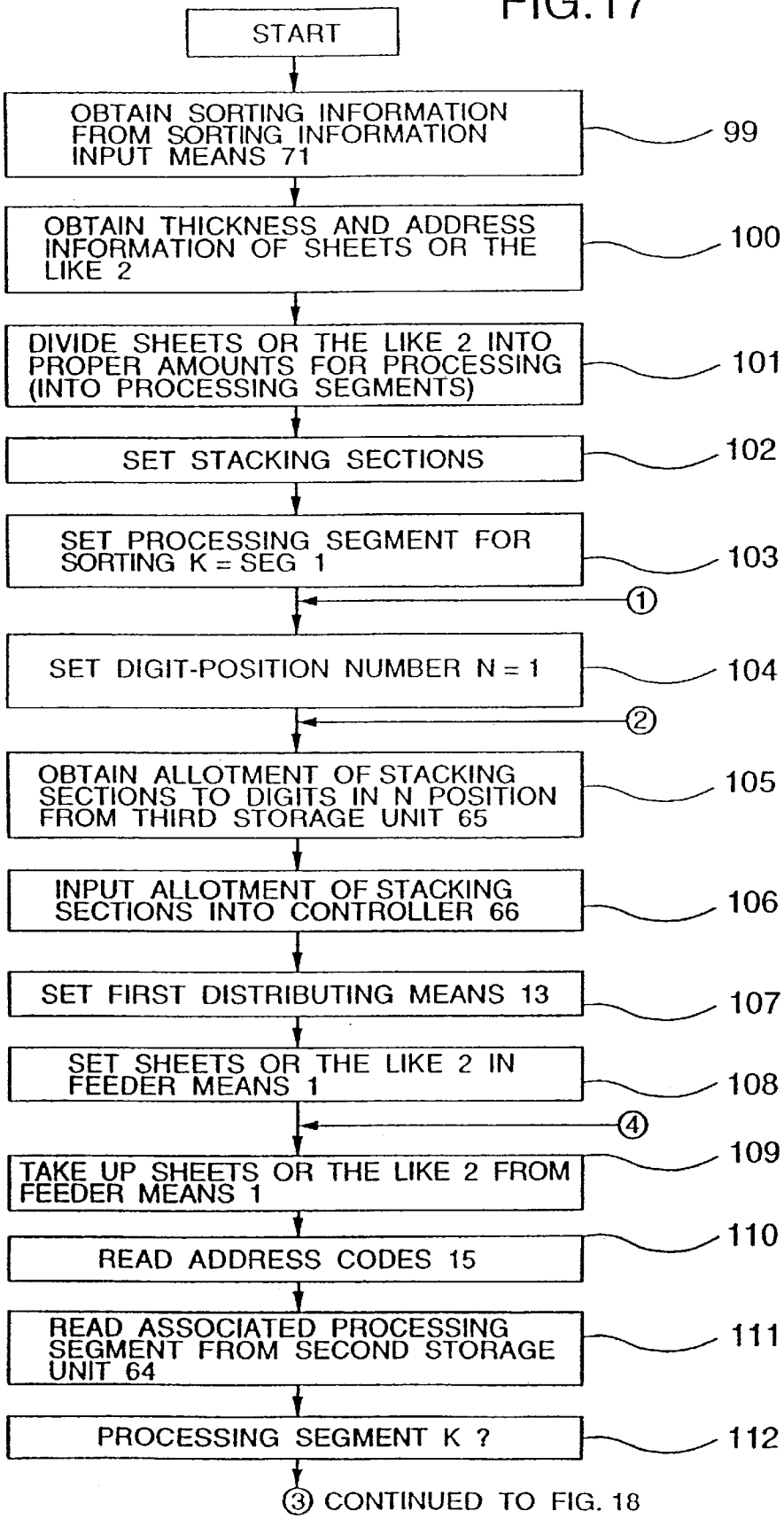
FIGS. 17 and 18 provide a flow chart showing operation procedures of the embodiment of the sheet or the like sorting apparatus according to the invention.
Figure 18:
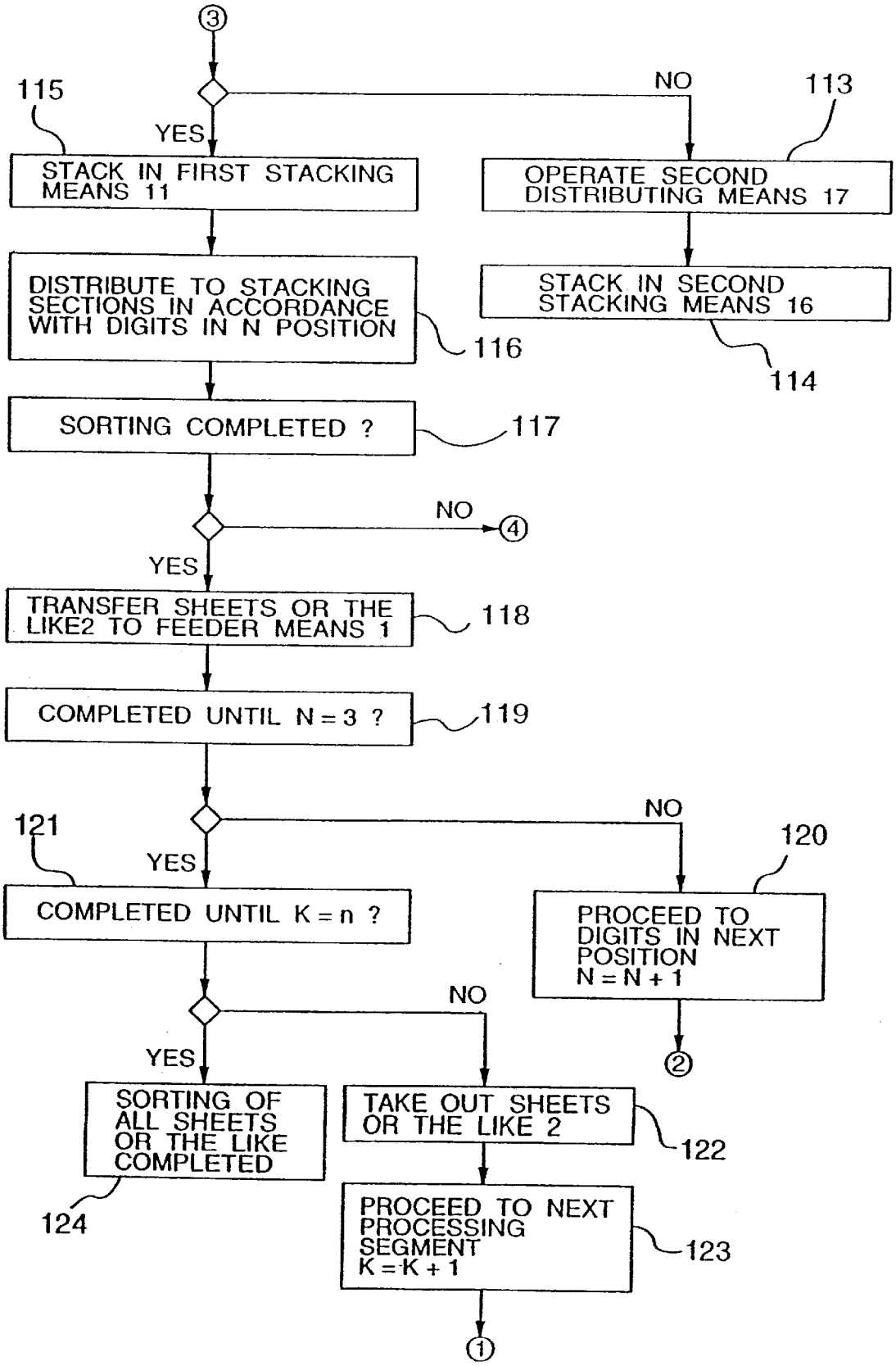

Referring to FIG. 17, sorting information of address codes 15 applied to the sheets or the like 2 to be processed, which indicates the carrier route, is obtained from the sorting information input devices 71 (step 99).

Next, the thickness and address codes 15 of all the sheets or the like 2 are obtained (step 100). This operation will be described with reference to FIG. 19.

Figure 19:
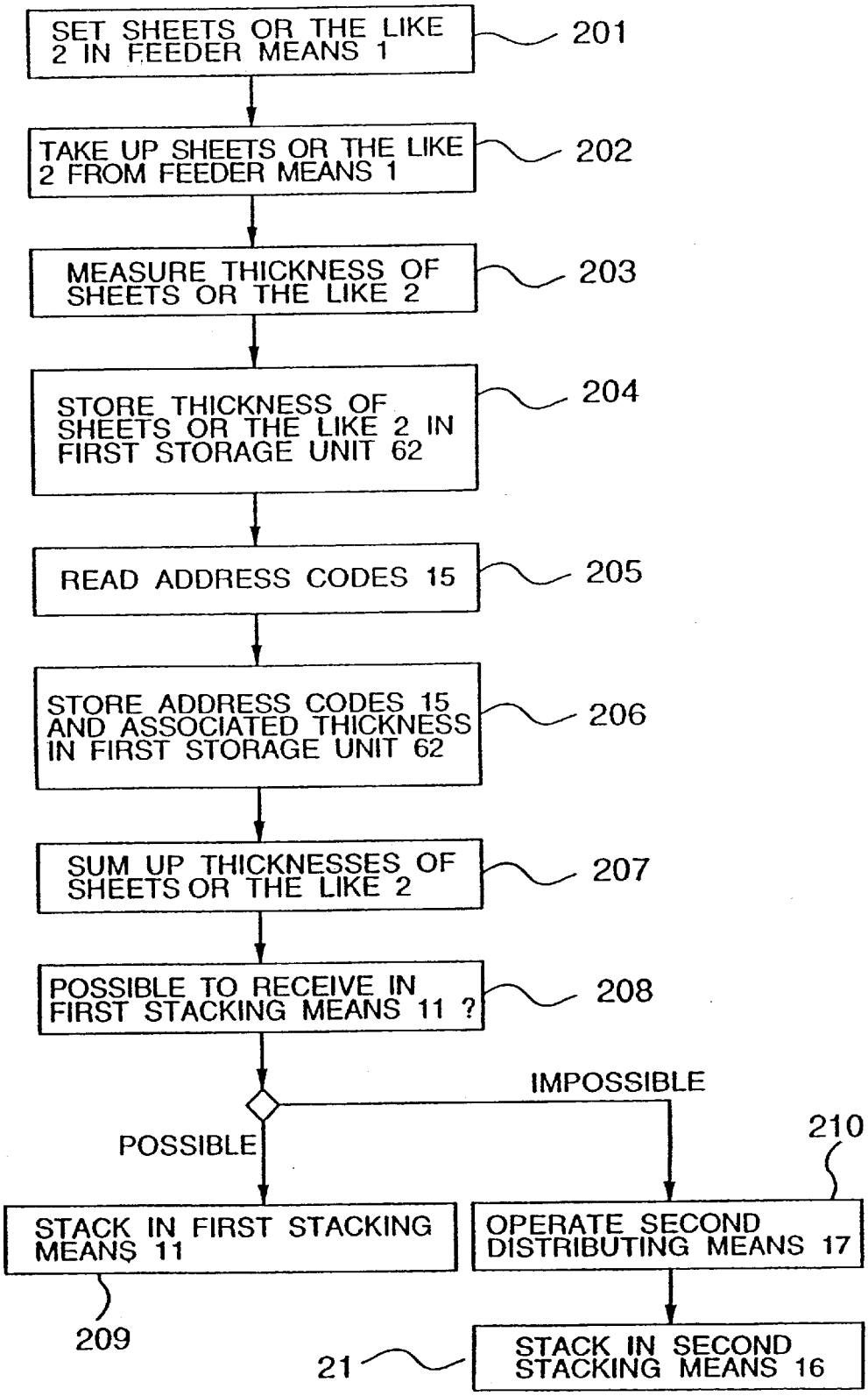
FIG. 19 is a flow chart showing operation procedures of the embodiment of the sheet or the like sorting apparatus according to the invention.

FIG. 19 is a flow chart showing operation of the device 18 for obtaining the thickness and the means of for obtaining the address codes 15 of the sheets or the like 2.

Referring to FIG. 19, when the sheets or the like 2 are supplied to the feeder devices 1 (step 201), the controller 66 transmits signals to the feeder devices controller 68 and the separator devices controller 67 so that the feeder devices 1 move the sheets or the like 2 toward the separator devices 4, and so that the separator devices 4 take up the sheets or the like 2 one by one from the right end and pass them to the conveyer passage 7 (step 202). The thickness of the sheet or the like 2 is determined by the thickness detecting devices 18 (step 203), which thickness is stored in the first storage unit 62 (step 204 ). The sheet or the like 2 is conveyed via the switch-back portion 8 to the address code reader device 9 in which the address code 15 which was applied to the sheet or the like 2 beforehand is read (step 205), and the address code 15 is inputted in the first storage unit 62 (step 206). In this manner, the address code 15 and the thickness of each of the sheets or the like 2 are stored in the first storage unit 62.

Table 1 shows one example of stored information in the first storage unit 62. In this table, entry numbers are numerals which are applied, for convenience's sake, to the sheets or the like 2 in order when they are fed. As shown in Table 1, the address code 15 and the thickness of each of the sheets or the like 2 are stored in an associated manner in the first storage unit 62.

TABLE 1

| CONTENTS OF FIRST STORAGE UNIT | | |
|---|---|---|
| ENTRY NUMBER | ADDRESS CODE | THICKNESS |
| 000 | COD981 | 2 |
| 001 | COD454 | 1 |
| 002 | COD214 | 1 |
| 003 | COD637 | 3 |
| 004 | COD020 | 1 |
| . | . | . |
| . | . | . |
| . | . | . |
| 998 | COD234 | 1 |
| 999 | COD522 | 5 |

When each of the sheets or the like 2 is fed, the thickness of the sheets or the like 2 is summed up (step 207), and if the total of the thickness of the fed sheets or the like 2 is smaller than the capacity of the first stacker devices 11, it is determined that the sheets or the like 2 can be collected in the first stacker devices 11 (208). In this case, the sheets or the like 2 are stacked in the first stacker devices 11 (209). If it is determined that the sheets or the like 2 can not be stacked, the second distribution control devices 61 are controlled (step 210) to collect the sheets or the like 2 in the second sorting devices 16 (step 211).

When the total amount of the sheets or the like 2 exceeds an amount which can be supplied to the feeder devices 1 at one time the sheets or the like 2 must be divided and processed. In this embodiment, the sheets or the like 2 are divided into some segments each of which has an amount which can be sorted at once, and each of these segments will be referred to as a processing segment (step 101, FIG. 17).

Figure 20:
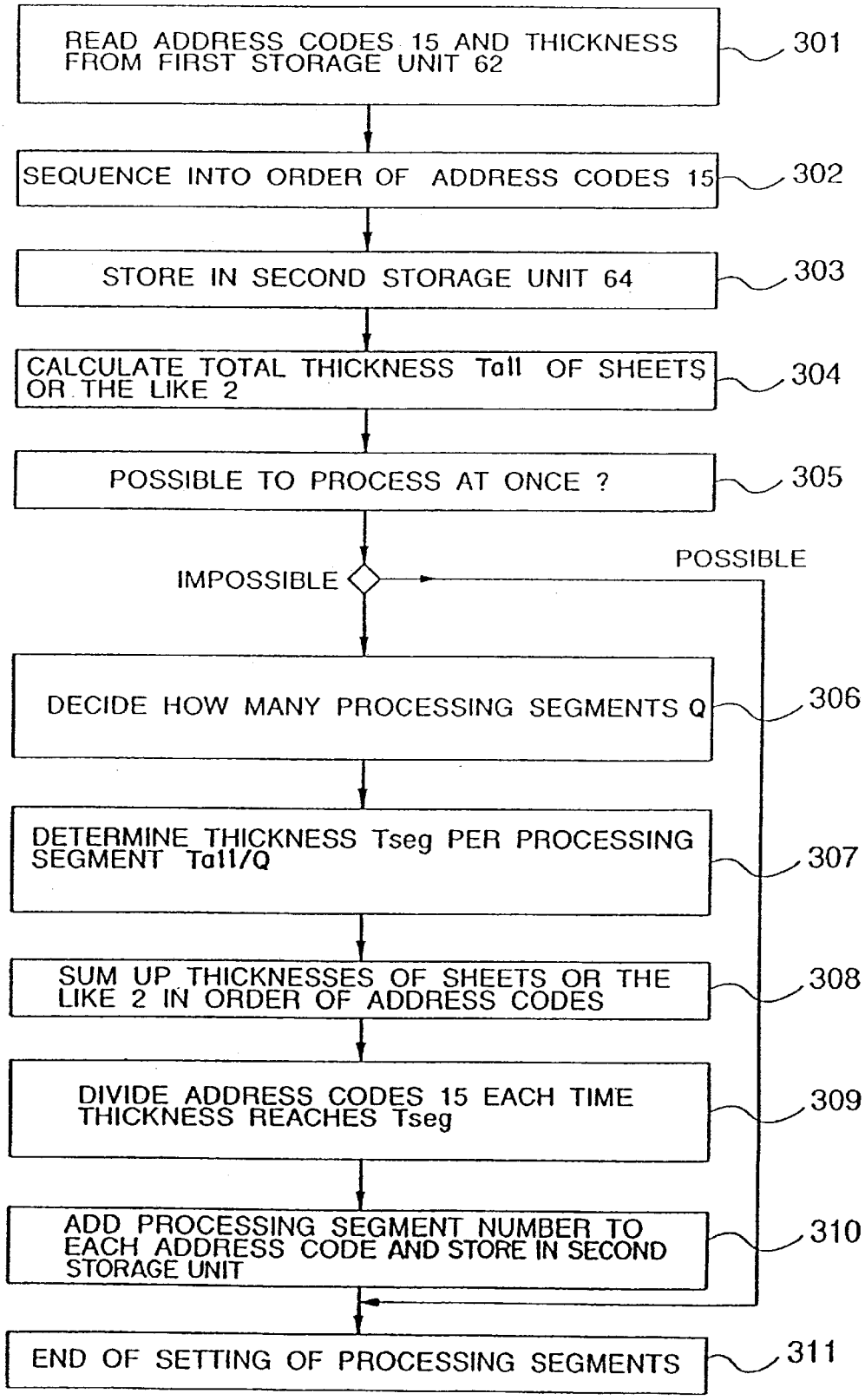
FIG. 20 is a flow chart showing operation procedures of the embodiment of the sheet or the like sorting apparatus according to the invention.

FIG. 20 shows one embodiment for setting processing segments.

Referring to FIG. 20, the address codes 15 and thickness of the sheets or the like 2 are read from the first storage unit 62 (step 301), sequenced in the serial order of the address codes 15 by the sequencer devices 63 (step 302), and stored in the second storage unit 64 (step 303). Table 2 shows one example of the contents in the second storage unit 64 at this time. In this example, the address codes 15 are stored in a first column 320, and the thicknesses are is stored in a second column 321.

TABLE 2

| ADDRESS CODE | THICKNESS t | PROCESSING SEGMENT | TOTAL THICKNESS |
|---|---|---|---|
| COD000 | 1 | SEG1 | |
| COD001 | 2 | SEG1 | |
| COD002 | 1 | SEG1 | |
| . | . | . | Σt < Tseg |

TABLE 2-continued

| ADDRESS CODE | THICKNESS t | PROCESSING SEGMENT | TOTAL THICKNESS |
|---|---|---|---|
| . | . | . | |
| . | . | . | |
| COD299 | 4 | SEG1 | |
| COD300 | 2 | SEG2 | |
| COD301 | 1 | SEG2 | |
| . | . | . | Σt < Tseg |
| . | . | . | |
| . | . | . | |
| COD649 | 2 | SEG2 | |
| COD650 | 1 | SEG3 | |
| COD651 | 2 | SEG3 | |
| . | . | . | |
| . | . | . | Σt < Tseg |
| . | . | . | |
| COD998 | 4 | SEG3 | |
| COD999 | 1 | SEG3 | |
| 320 | 321 | 322 | |

Next, the thickness of all the sheets or the like 2 is added up in the serial order from the top of the address codes 15 stored in the second storage unit 64, to thereby derive the total thickness Tall of the sheets or the like 2 (step 304 ). Then, the total thickness Tall is compared with a thickness R of sheets or the like which can be supplied to the feeder devices 1 at one time (step 305). When Tall<R, all the sheets or the like 2 can be processed at once. Otherwise, the sheets or the like 2 must be divided into some processing segments.

First, the total thickness of sheets or the like 2 which can be supplied to the feeder devices 1 at once is expressed as R, and Tall/R is calculated. By raising the decimals of the resultant value to a unit, an integer value Q is obtained. Thus, the value Q can be determined as the number of divisions of the sheets or the like 2, i.e., the number of processing segments (step 306). That is to say, the sheets or the like 2 are divided into Q processing segments each having a thickness Tseg=Tall/Q (step 307). Because Tseg<R, each processing segment can be supplied to the feeder devices 1 at once. In this embodiment, an explanation will be given on the case where Q=3.

When, the thicknesses of the sheets or the like 2 are summed up in the serial order of the address codes 15 from COD000 (step 308) and expressed as Σt, a range, of the address codes 15 in a range Σt<Tseg is derived. For example, if the sum of thicknesses of the sheets or the like 2 from COD000 to COD299 is smaller than the processing segment thickness Tseg, and if the sum of thicknesses of the sheets or the like 2 from COD000 to COD300 is larger than Tseg, the sheets or the like 2 from COD000 to COD299 can be regarded as one processing segment (step 309). This is referred to as a first processing segment SEG1 and this reference numeral is additionally applied to each of the address codes 15. The resultant codes are stored in the second storage unit 64 (step 310). Processing segments of the sheets or the like 2 of COD300 and the following codes can be set each time the sum of thickness reaches the processing segment thickness Tseg, to thereby complete setting of the processing segments (step 311). Table 2 shows one example of the contents of the second storage unit 64 when the processing segments are set. More specifically, the thickness and the processing segment numerals SEG1 to SEG3 of the sheets or the like 2 are added to the address codes 15 in the serial order, and the address codes COD300 to COD649 are regarded as a second processing segment SEG2, the address codes COD650 to COD999 being regarded as a third processing segment SEG3. Sets of the sheets or the like 2 belonging to the three processing segments have a substantially uniform total thickness Σt.

Each of the sets of the sheets or the like 2 belonging to the first to third processing segments SEG1 to SEG3 has an number of sheets or the like which can be supplied to the feeder devices 1 at one time. However, if the number of sheets or the like 2 corresponding to some of the address codes 15 is large, or if a large number of thick sheets or the like 2 are processed, the sheets or the like 2 overflow the stacking section in question. In order to avoid such a situation, a stacking section where overflowing of sheets or the like 2 may occur is predicted, and a plurality of continuous stacking sections are allotted in place of the stacking section in question, thus preventing the occurrence of overflowing (step 102, FIG. 17).

Figure 21:
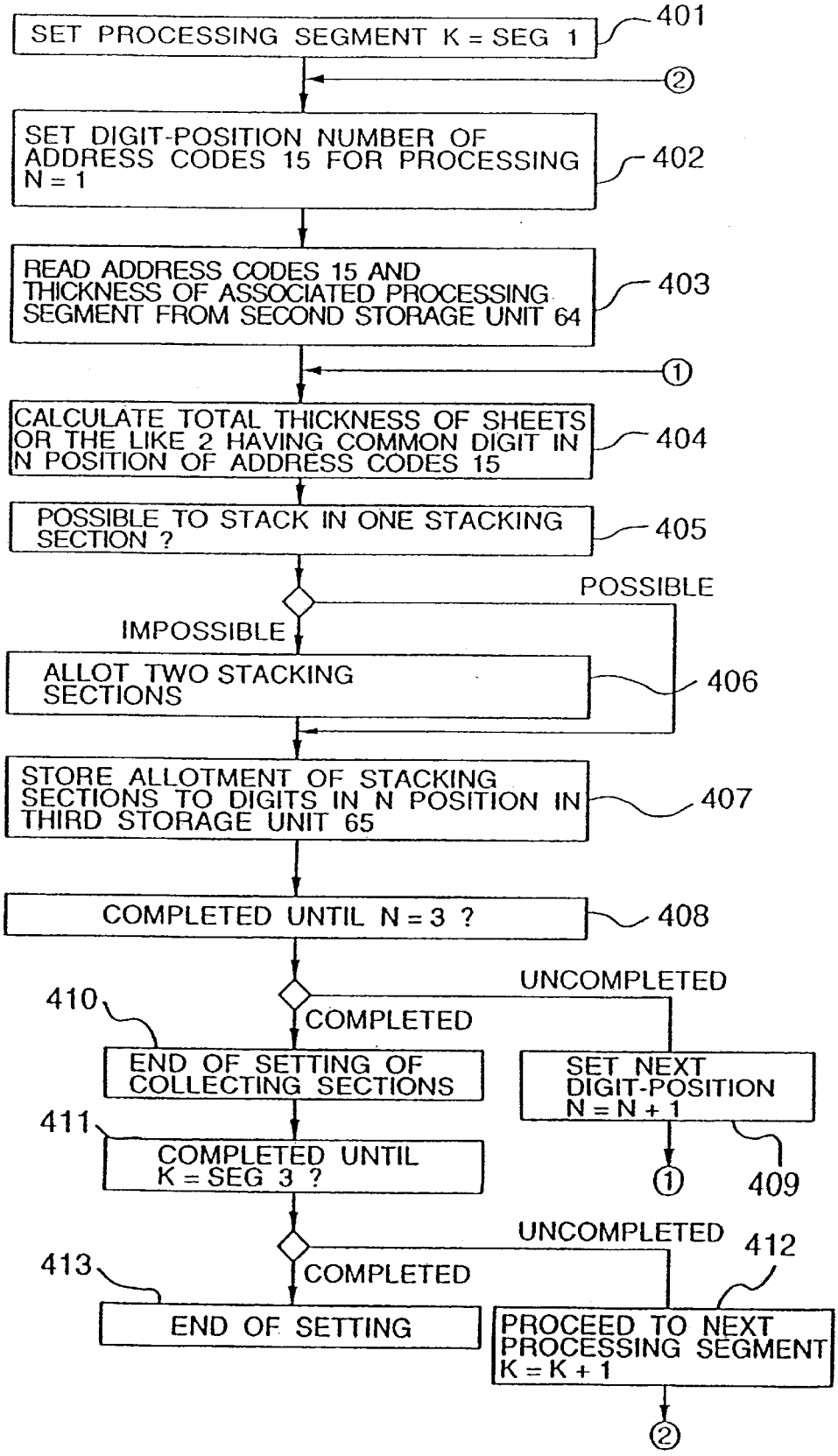
FIG. 21 is a flow chart showing operation procedures of the embodiment of the sheet or the like sorting apparatus according to the invention.

Devices for setting stacking sections will now be described with reference to FIG. 21. FIG. 21 is a flow chart showing the devices for setting stacking sections. As has been described in the explanation of the carrier route sequencing operation with reference to FIGS. 9 to 15, sheets or the like 2 whose address codes 15 have a common digit in each position are stacked in one stacking section every time the sorting operation is performed. Therefore, thickness of sheets or the like 2 stacked in one stacking section corresponding to a digit in each position of the codes is calculated in advance, to thereby predict the occurrence of overflowing of the sheets or the like 2.

The sorting operation starts from digits in the first position from the right of address codes of the first processing segment SEG1. One example of this operation will be described with reference to FIG. 21 and Tables 3 and 4.

TABLE 3

EXAMPLE OF DISTRIBUTING FIRST-POSITION DIGITS OF ADDRESS CODES IN FIRST PROCESSING SEGMENT

| | a | | b | | | j | |
|---|---|---|---|---|---|---|---|
| | ADDRESS CODE | THICK-NESS | ADDRESS CODE | THICK-NESS | . . . | ADDRESS CODE | THICK-NESS |
| | COD180 | 5 | COD211 | 2 | . . . | COD159 | 1 |
| | COD070 | 1 | COD051 | 3 | . . . | COD049 | 2 |
| | COD150 | 1 | COD091 | 2 | . . . | COD239 | 1 |
| | COD290 | 2 | COD171 | 1 | . . . | COD029 | 1 |
| | . | . | . | . | . . . | . | . |
| | . | . | . | . | . . . | . | . |
| | . | . | . | . | . . . | COD119 | 4 |
| | COD020 | 4 | COD241 | 2 | . . . | | |
| | | | COD121 | 1 | . . . | | |
| TOTAL THICK-NESS | ΣCODxx0 | 65 (<s) | ΣCODxx1 | 152 (>s) | . . . | ΣCODxx9 | 85 (<s) |
| NUMBER OF STACK-ING SEC-TIONS | 1 | | 2 | | . . . | 1 | |

s = 120

TABLE 4

EXAMPLE OF CONTENTS OF THIRD STORAGE UNIT

| PROCESSING SEGMENT | | FIRST PROCESSING SEGMENT SEG1 | | | SECOND PROCESSING SEGMENT SEG2 | | | THIRD PROCESSING SEGMENT SEG3 | | |
|---|---|---|---|---|---|---|---|---|---|---|
| DISTRIBUTING DIGIT POSITION | | THIRD POSI-TION | SECOND POSI-TION | FIRST POSI-TION | THIRD POSI-TION | SECOND POSI-TION | FIRST POSI-TION | THIRD POSI-TION | SECOND POSI-TION | FIRST POSI-TION |
| STACKING SECTION | S1 | 0 | 9 | 0 | 3 | 9 | 0 | 6 | 9 | 0 |
| | S2 | 0 | 8 | 1 | 3 | 8 | 1 | 6 | 9 | 0 |
| | S3 | 0 | 7 | 1 | 3 | 7 | 2 | 7 | 8 | 1 |
| | S4 | 1 | 7 | 2 | 4 | 6 | 2 | 7 | 7 | 2 |
| | S5 | 1 | 6 | 3 | 4 | 5 | 3 | 7 | 6 | 3 |
| | S6 | 1 | 5 | 4 | 4 | 4 | 4 | 8 | 5 | 4 |
| | S7 | 1 | 4 | 5 | 4 | 3 | 5 | 8 | 4 | 4 |
| | S8 | 2 | 3 | 5 | 5 | 2 | 6 | 8 | 3 | 5 |
| | S9 | 2 | 3 | 6 | 5 | 1 | 6 | 9 | 2 | 6 |
| | S10 | 2 | 2 | 7 | 5 | 0 | 7 | 9 | 1 | 7 |

TABLE 4-continued

| EXAMPLE OF CONTENTS OF THIRD STORAGE UNIT | | | | | | | | | |
|---|---|---|---|---|---|---|---|---|---|
| PROCESSING SEGMENT | FIRST PROCESSING SEGMENT SEG1 | | | SECOND PROCESSING SEGMENT SEG2 | | | THIRD PROCESSING SEGMENT SEG3 | | |
| DISTRIBUTING DIGIT POSITION | THIRD POSI-TION | SECOND POSI-TION | FIRST POSI-TION | THIRD POSI-TION | SECOND POSI-TION | FIRST POSI-TION | THIRD POSI-TION | SECOND POSI-TION | FIRST POSI-TION |
| S11 | 2 | 1 | 8 | 6 | — | 8 | 9 | 1 | 8 |
| S12 | 2 | 0 | 9 | 6 | — | 9 | 9 | 0 | 9 |
| | a | b | c | d | e | f | g | h | i |

First, a processing segment is determined and in this example, the first processing segment SEG1 is selected (step 401). Then, a digit position number N of address codes is set. In this example, the operation starts from a digit in the first position from the right of the address codes, and consequently, N=1 (step 402). Next, address codes 15 of the sheets or the like 2 belonging to the first processing segment SEG1, i.e., COD000 to COD299, and thicknesses of the sheet or the like 2 corresponding to the respective address codes 15 are read from the second storage unit (step 403). After that, groups of address codes 15 which have common digits in the first position are collected (step 404). More specifically, as shown in Table 3, for example, address codes 15 having 0 in the first position and the associated thicknesses are only collected in a column a, and address codes 15 having 1 in the first position and the associated thicknesses are only collected in a column b, and then, this operation is likewise repeated with address codes 15 having 2 to 9 in the first position.

Next, the thicknesses of sets of the sheets or the like 2 which have been stacked in accordance with the respective digits in the first position of the address codes 15 are summed up (step 404). When x expresses an arbitrary digit, the total thickness of the sheets or the like 2 having 0 in the first position of the address codes is expressed as ΣCODxx0, and the thickness of the sheets or the like 2 which can be stacked in one stacking section is expressed as s. For example, the thickness s is 120 mm. If ΣCODxx0 is 65 mm, for example, these sheets or the like 2 can be stacked in one stacking section because ΣCODxx0<s. If ΣCODxx1 is 152 mm, for example, these sheets or the like 2 can not be stacked in one stacking section because ΣCODxx1>s (step 405). Consequently, it is judged that two stacking sections are allotted to the sheets or the like 2 having 1 in the first position of the address codes (step 406).

Thereafter, such an operation is repeated for the sheets or the like 2 having 2 to 9 in the first position of the address codes. Two stacking sections are allotted to each of the sets of the sheets or the like 2 having, for example, 1 and 5, in the first position of the address codes, and one stacking section is allotted to each of the other sets of the sheets or the like 2.

As for the digits in the first position of the codes in the first processing segment, when 12 stacking sections are referred to as S1 to S12, the digit 0 is allotted to a stacking section S1, and the digit 1 is allotted to stacking sections S2 and S3. When the digits 2 to 9 in the first position are likewise allotted to the other stacking sections in this order, as shown in a column c of Table 4, the digits in the first position of the address codes are allotted to all the stacking sections S1 to S12, and this allotment is stored in the third storage unit 65 (step 407).

Thus, the allotment of the digits in the first position of the address codes in the first processing segment SEG1 is completed. It is judged whether the allotment of the digits up to N=3 is completed or not (step 408). If not, the digit position number is set as N=N+1=2 (step 409), and the digits in the second position from the right of the address codes are allotted to the stacking sections S1 to S12. However, as has been described with reference to FIGS. 9 to 15, the order of the digits corresponding to the stacking sections must be reversed each time the digit position number of the address codes is changed, and consequently, in the second position of the address codes, the digit 9 is allotted to the stacking section S1 and the digit 0 to the stacking section S12. A column b of Table 4 shows one example in which two continuous stacking sections are allotted to each of sets of sheets or the like 2 having 3 and 7 in the second position of the address codes 15 of the first processing segment SEG1. Since only the sheets or the like 2 from COD000 to COD299 belong to the first processing segment SEG1, the digits 0 to 2 in the third position from the right of the address codes are allotted to the stacking sections in this order. Because the order of the digits must be made reverse to that of the digits in the second position, the digit 0 is allotted to the stacking section Si and the digit 2 to the stacking section S12.

When the digit allotment of the third position is completed (step 410), it is judged whether setting of the third processing segment SEG3 is completed or not (step 411). If not, the processing segment number is set as K=K+1=SEG2 (step 412), and stacking sections for the second processing segment SEG2 are determined, and similar operation is repeated for the third processing segment SEG3. Then, as shown in columns d to i of Table 4, all the stacking sections for all the processing segments are determined for the digits in the respective positions of the address codes (step 413). If overflowing of sheets or the like 2 occurs in none of the stacking sections, only the stacking sections S1 to S10 are used, as shown in column e of Table 4, and the other stacking sections need not be used.

Thus, allotments of all the stacking sections S1 to S12 in all the processing segments SEG1 to SEG3 corresponding to the digits in the respective positions of the address codes are stored in the third storage unit 65, to thereby complete setting of the stacking sections.

Next, in order to start processing from the first processing segment SEG1, the processing segment number K=SEG1 is set (step 103).

First, in order to sort the sheets or the like 2 in accordance with the digits in the first position from the right of the address codes 15 in a manner shown in FIGS. 9 and 10, the digit position number N=1 is set (step 104). Then, the allotment of stacking sections to the digits in the first position of the address codes in the first processing segment SEG1 (according to the column c of Table 4) is obtained from the third storage unit 65 (step 105), and it is inputted to the controller 66 (step 106). In response to the allotment setting, the controller 66 sends a command to the first distribution control unit 60 and controls the gate diverters 35*a* to 35*j* (step 107).

When the sheets or the like 2 are supplied again to the feeder devices 1 (step 108), the controller 66 transmits signals to the feeder devices controller 68 and the separator devices controller 67, so that the feeder devices 1 move the sheets or the like 2 toward the separator devices 4, and so that the separator devices 4 take up the sheets or the like 2 one by one from the right end and pass them to the conveyer passage 7 (step 109).

An address code of the sheet or the like 2 is read by the address code reader devices 9 (step 110). The read address code is checked with the contents of the second storage unit 64 (step 111), and it is judged which of the first to third processing segments SEG1 to SEG3 the sheet or the like 2 belongs to (step 112). If the sheet or the like 2 belongs to the second or third processing segment SEG2 or SEG3, the controller 66 sends a command to the second distribution control unit 60 so as to actuate the second distributor device 17 (step 113), and the sheet or the like 2 is stacked in the second stacker devices 16 (step 114 ).

If the sheet or the like 2 belongs to the first processing segment SEG1, it is stacked in the first stacker devices 11 (step 115). In accordance with a digit in the first position from the right of the address code, the first distribution control unit 61 sends a command for actuating the associated gate diverters 35*a* to 35*j*. For example, if the address code is COD180, it is checked with the contents of the second storage unit 64 , and consequently, it is found out that the address code belongs to the first processing segment SEG1. Further, when the address code is checked with the contents of the third storage unit 65, it is judged that the address code indicates a sheet or the like 2 to be stacked in the stacking section S1. Then, the controller 66 sends a command for actuating the gate diverter 35*a*, to the first distribution control unit 60, and the sheet or the like 2 of the address code COD180 is stacked in the stacking section S1 of the first stacker devices 11 (step 116).

It is judged whether all the sheets or the like 2 are stacked in the first stacker devices 11 or the second stacker devices 16 (step 117). If not, feeding of the sheets or the like 2 is continued. After the completion, only the sheets or the like 2 belonging to the first processing segment SEG1 are stacked in the first stacker devices 11 in a sorted state in accordance with the digits in the first position of the address codes on the basis of the allotment of the stacking sections which is stored in the third storage unit 65, as shown in the column c of Table 4.

Next, the sheets or the like 2 stacked in the first stacker devices 11 are shifted to the feeder devices 1 without changing the order of the sheets or the like 2 (step 118). At this time, because the first stacker devices 11 are located above the feeder devices 1, the sheets or the like 2 sorted and stacked in the stacking sections S1 to S12 of the first stacker devices 11 are merely moved to the feeder devices 1 located below. Therefore, the sheets or the like 2 need not be shifted into a tray or the like temporarily and moved to the vicinity of the feeder devices 1. The sheets or the like 2 can be easily supplied to the feeder devices 1 again.

With the above-described procedures, sorting in accordance with the digits in the first position of the address codes is completed. Next, it is judged whether sorting until the third position of the address codes is completed or not (step 119). If not, the digit position number is set as N=N+1=2, and sorting is conducted in accordance with the digits in the second position of the address codes (step 54120). When starting the second-position distribution, the allotment of the stacking sections shown in the column b of Table 4is obtained from the third storage unit 65 (step 105). Thereafter, similar operation is repeated to repeat sorting through the third position of the address codes. In consequence, in the same manner as has been described with reference to FIGS. 9 to 15, the sheets or the like 2 of the first processing segment SEG1 can be sequenced in the serial order of the address codes COD000 to COD299.

Next, it is judged whether processing of all the processing segments SEG1 to SEG3 is completed or not (step 121). When processing of the sheets or the like 2 belonging to only the first processing segment SEG1 is only finished, all the sheets or the like 2 are removed from the first stacker devices 11 (step 122), and the next processing segment K=K+1= SEG2 is set (step 123), and then, sheets or the like 2 belonging to the second processing segment SEG2 are provided in the feeder devices 1 (step 108), to thereby start processing them. At this time, the sheets or the like 2 belonging to the second processing segment SEG2 and sheets or the like 2 belonging to the third processing segment SEG3 are stacked in the second stacker devices 16, so that the sheets or the like 2 belonging to the second proccessing segment SEG2 must be removed from the second stacker devices 16 and supplied to the feeder devices 1.

If the second stacker devices 16 are divided into, for example, two sections a and b, the sheets or the like 2 belonging to the second processing segment SEG2 can be stacked in the section a, and the sheets or the like 2 belonging to the third processing segment SEG3 can be stacked in the section b. With such a structure, sheets or the like 2 can be stacked in the second stacker devices 16 in a sorted state in accordance with the processing segments.

When sequencing of the sheets or the like 2 in all the processing segments is completed (step 124), the sheets or the like 2 from the first processing segment SEG1 to the third processing segment SEG3 are sequenced to carrier route of the respective processing segments. When the sheets or the like 2 are placed in the order of the processing segments SEG1 to SEG3, all the sheets or the like 2 are placed in the serial order of the address codes COD000 to COD999, thus completing carrier route sequencing of all the sheets or the like 2.

With the above-described structure, mail can be sorted into an order corresponding to the carrier route by devices of a small-sized sorting apparatus having about 10 stacking sections. Moreover, the thickness of each sheet or the like 2 is measured, and the address code 15 is processed along with this thickness, so that sheets or the like 2 exceeding the number which can be supplied to the feeder devices 1 at once can be divided into some sets to be processed, and so that carrier route sequencing of all the sheets or the like 2 can be accordingly performed. Furthermore, overflowing of sheets or the like 2 from a stacking section of the first stacker devices 11 in the process of carrier route sequencing operation is predicted, and a plurality of stacking sections are allotted in place of the stacking section in question, thereby preventing such overflowing.

Figure 22:
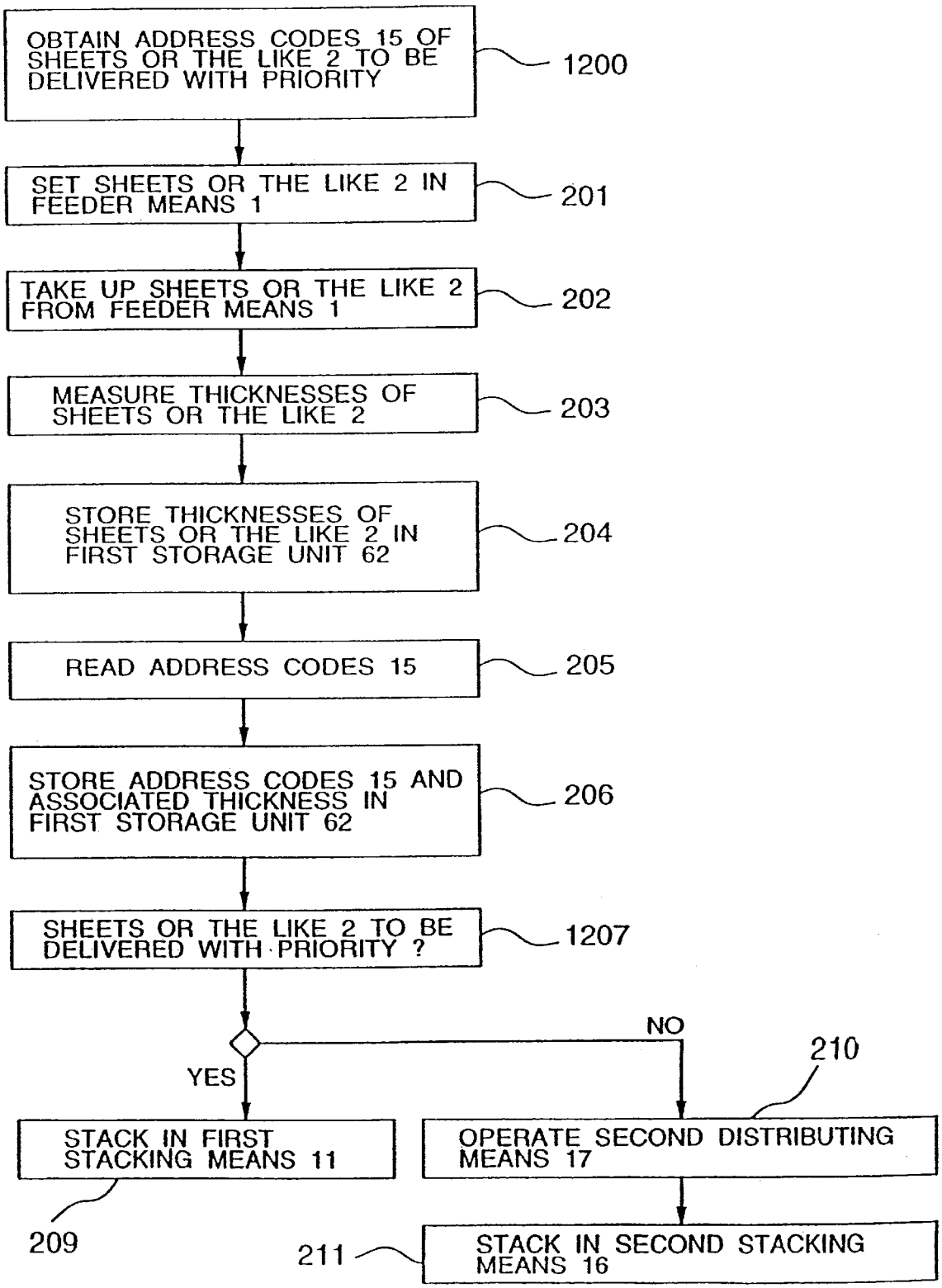
FIG. 22 is a flow chart showing operation procedures of another embodiment of a sheet or the like sorting apparatus according to the invention.

As another embodiment, there will be described the structure in which when mail per carrier is sequenced into mail to be delivered with priority and mail to be delivered normally, carrier route sequencing of the mail with priority is performed ahead of the other mail. Referring to FIG. 22, address codes 15 of sheets or the like 2 to be delivered with priority are obtained from sorting information input devices 71 (step 1200). Operations from step 201 to step 206 are the same as those of the embodiment described with reference to FIG. 19. Next, it is judged whether each sheet or the like 2 is a sheet or the like 2 to be delivered with priority or not (step 1207). If it is the sheet or the like 2 to be delivered with priority, it is stacked in the first stacker devices 11 (step 209). If not, the second distributor devices 17 are operated (step 210), and the sheet or the like 2 is stacked in the second stacker devices 16 (step 211).

With such a structure, only the sheets or the like 2 to be delivered with priority can be stacked in the first stacker devices 11, and when processing of step 101 and the following steps in FIG. 17 is subsequently carried out, carrier route sequencing of the sheets or the like 2 with priority can be performed ahead of the others.

In the embodiments of the present invention, the thickness of all the sheets or the like 2 is measured. However, if the thickness of the sheets or the like 2 is found beforehand, the thickness measurer devices 18 can be omitted. For example, in the case of a sheets or the like sorting apparatus which exclusively sorts postal cards, thickness measurement can be omitted, and the known thickness of postal cards can be used as the thickness of the sheets or the like 2.

As a further embodiment, there will be described one example of devices for shifting sheets or the like 2 from the first stacker devices 11 to the feeder devices 1 without human labor.

In this embodiment, as shown in FIG. 1, the bottom plate 12 is movably supported. When the bottom plate 12 is moved backwardly, the boundary between the first stacker devices 11 and the feeder devices 1 disappears, and the sheets or the like 2 stacked in the first stacker devices 11 fall down into the feeder devices 1 without changing the order to which they were stacked in the first stacker devices 11.

For example, referring to FIG. 10, when the bottom plate 12 of the first stacker devices 11 is moved and pulled out, all the sheets or the like 2 stacked in the stacking sections S1 to S12 of the first stacker devices 11 fall down into the feeder devices 1 in unchanged order so that the same condition shown in FIG. 11 can be obtained. That is to say, referring to FIG. 18, in the operation of shifting the sheets or the like 2 to the feeder devices 1 (step 118), the bottom plate 12 of the first stacker devices 11 is moved and pulled out so as to move the sheets or the like 2 to the feeder devices 1.

Figure 23:
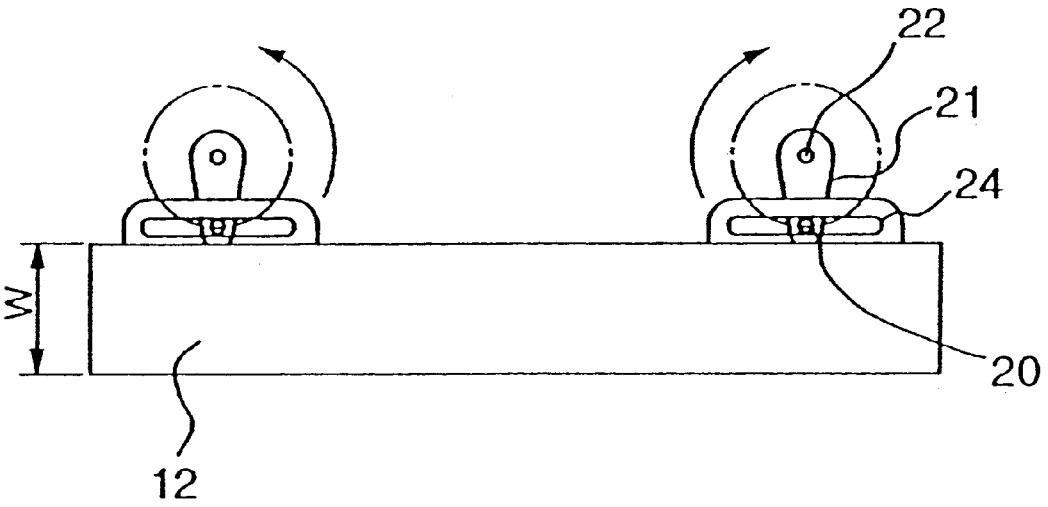
FIG. 23 is a plan view showing one example of the structure for moving a bottom plate of the sheet or the like sorting apparatus according to the invention.
Figure 24:
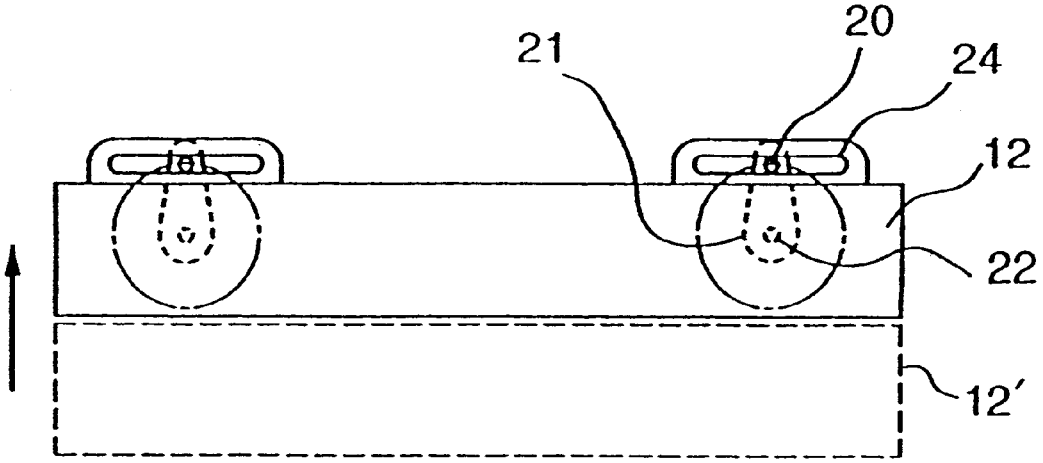
FIG. 24 is a plan view showing the operation of the example of the structure for moving the bottom plate of the sheet or the like sorting apparatus according to the invention shown in FIG. 23.

FIGS. 23 and 24 are plan views showing one example of the structure for moving the bottom plate 12. In FIG. 23, reference numeral 24 denotes a slit provided on the bottom plate 12, 21 denotes a cam which rotates around a rotation axis 22, and 20 denotes a pin provided on one end of cam which is supported to be able to slide along the slit 24.

FIG. 24 shows the condition in which the cams 21 are rotated 180° about the rotation axes 22. When the cams 21 are rotated about the rotation axes 22, the pins 20 are moved toward the rotation axes 22 of the cams 21 because the pin 20 is supported to be able to move along the slit 24, and consequently, the whole bottom plate 12 is moved toward the rotation axes 22 of the cams 21. In this case, the distance of the movement of the bottom plate 12 is the rotation diameter of the cam 21, i.e., twice as large as the distance between the rotation axis 22 and the pin 20. In accordance with the required distance of the movement of the bottom plate 12, the rotation diameter of the cam 21 can be determined.

In this embodiment, rotational cams are employed. However, the present invention is not limited to such a structure. For example, linear movement devices by use of air pressure or hydraulic pressure may be employed.

A still other embodiment of devices for shifting sheets or the like 2 from the first stacker devices 11 to the feeder devices 1 without human labor will be described with reference to FIGS. 25 to 28.

In FIGS. 25 to 28, reference numeral 40 denotes a bottom plate of the feeder devices 1, 43*a* and 43*b* denote links which can be pivotally moved around a fixed rotation axis 41, 44*a* and 44*b* denote links each having one end pivotally supported at a rotation axis 45 fixed on the bottom plate 40 whereas the other ends of the links 44*a* and 44*b* are pivotally supported by the links 43*a* and 43*b* through connecting axes 42*a* and 42*b*, respectively.

Figure 25:
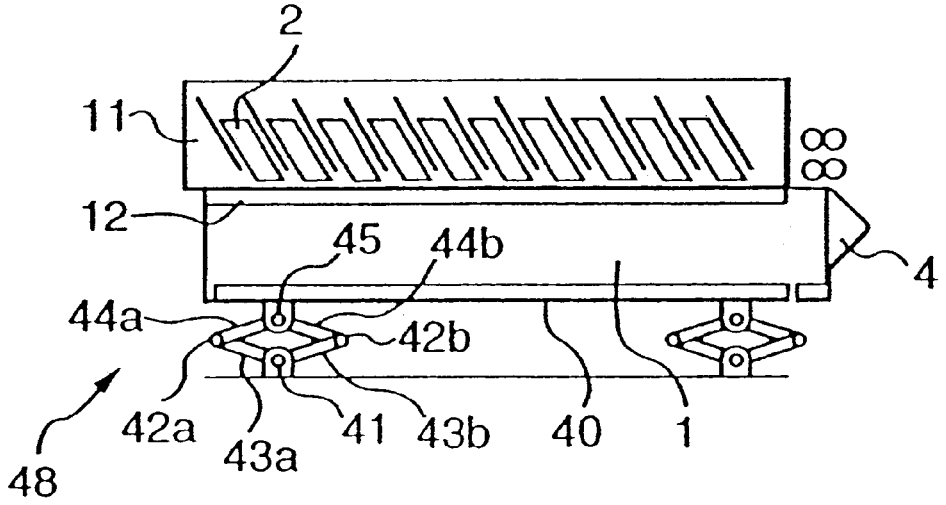
FIG. 25 is a front view showing one embodiment of devices for shifting sheets or the like from first stacker devices to feeder devices according to the present invention.
Figure 26:
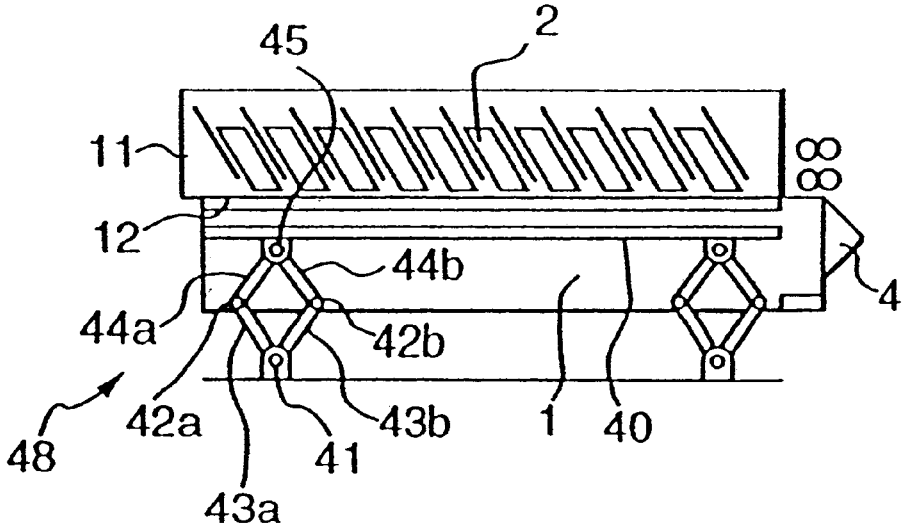
FIG. 26 is a front view showing the operation of the embodiment of the devices for shifting sheets or the like from the first stacker devices to the feeder devices shown in FIG. 25.
Figure 27:
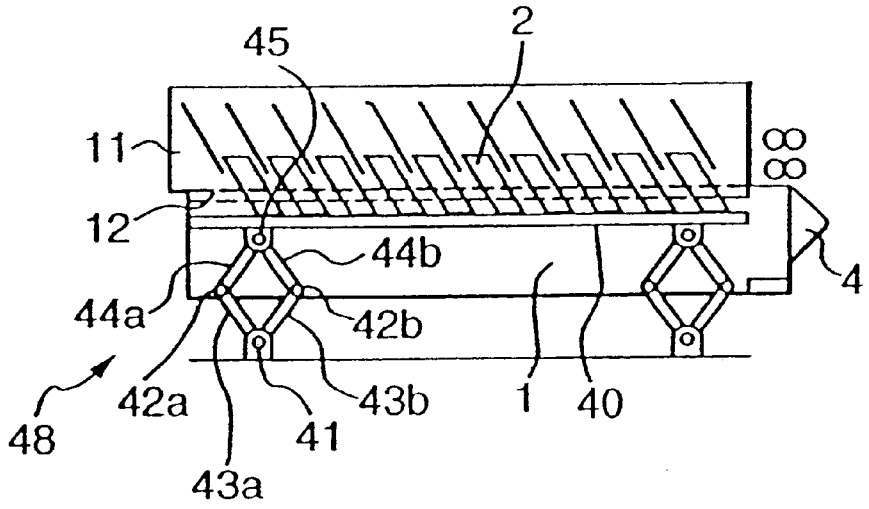
FIG. 27 is a front view showing the operation of the embodiment of the devices for shifting sheets or the like from the first stacker device to the feeder device shown in FIG. 25.
Figure 28:
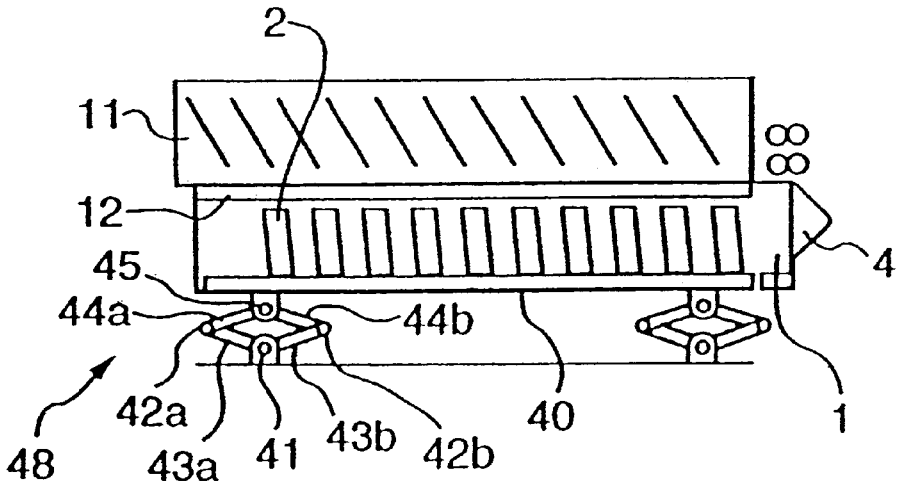
FIG. 28 is a front view showing the operation of the embodiment of the devices for shifting sheets or the like from the first stacker devices to the feeder devices shown in FIG. 25.

FIG. 25, similar to FIG. 10 or 12, shows a condition in which sheets or the like 2 are sorted to and stacked in the first stacker devices 11. Next, when the links 43*a* and 43*b* are moved inwardly toward each other, as shown in FIG. 26, the bottom plate 40 of the feeder devices 1 is raised. As shown in FIG. 27, when the bottom plate 12 of the first stacker devices 11 is pulled out by, for example, the structure shown in FIGS. 23 and 24, the sheets or the like 2 which have been stacked in the first stacker devices 11 fall down onto the bottom plate 40 of the feeder devices 1. After that, the bottom plate 40 of the feeder devices 1 is lowered to the position shown in FIG. 25, and the bottom plate 12 of the first stacker devices 11 is returned to the original position. In consequence, the sheets or the like 2 are shifted into the feeder devices 1, as- shown in FIG. 28, so that they can be fed to the separator devices 4 again. FIG. 28 shows the same condition as shown in FIG. 11 or 13 or 15. In FIGS. 25 to 28, the structure with the links is shown. However, the present invention is not limited to such a structure. An actuator or the like for linear movement may be employed to move the bottom plate 40 of the feeder devices 1.

In the case of the structure shown in FIGS. 23 and 24 in which the sheets or the like 2 are shifted from the first stacker devices to the feeder devices 1 by merely pulling out the bottom plate 12, the distance of falling down of the sheets or the like 2 corresponds to the height of the feeder devices 1, and consequently, it is feared that sheets or the like 2 having low rigidity may buckle when they fall down. However, in the case of the structure shown in FIGS. 25 to 28, the distance of falling down of the sheets or the like 2 is only the remainder of the height of the feeder devices 1 after the distance of upward movement of the bottom plate 40 of the feeder devices 1 is subtracted, so that buckling of the sheets or the like 2 is prevented, and so that the sheets or the like 2 can be reliably shifted from the first stacker devices to the feeder devices 1.

Figure 29:
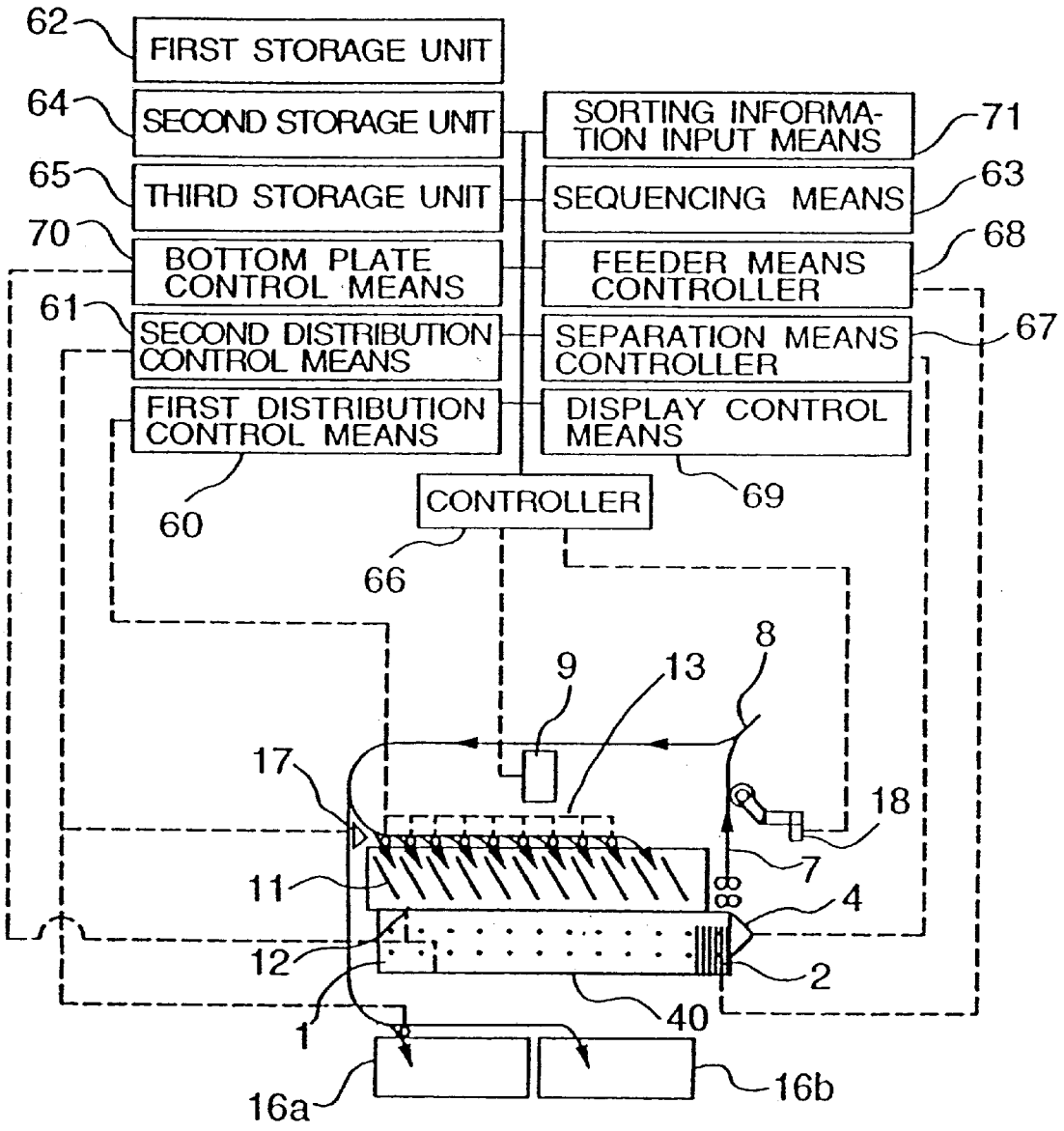
FIG. 29 is a block diagram showing the structure of another embodiment of a sheets or the like sorting apparatus according to the present invention.

FIG. 29 is a block diagram showing the structure of one embodiment of a sheet or the like sorting apparatus having devices for shifting sheets or the like 2 from the first stacker devices 11 to the feeder devices 1 without human labor. This embodiment is only different from that shown in FIG. 16 in that it includes a bottom plate control unit 70 for controlling devices for pulling out the bottom plate 12 of the first stacker devices 11, and devices for raising and lowering the bottom plate 40 of the feeder devices 1.

In the sheets or the like sorting apparatus according to the present invention, for example, sheets or the like 2 whose address codes 15 could not be read normally and sheets or the like 2 which were judged to be unsuitable for conveyance are discharged from the conveyer passage and stacked in the sheets or the like discharge portion 10 when the carrier route sequencing is completed. The sheets or the like 2 thus discharged must be inserted in certain places between the other sheets or the like 2 in the serial order of the address codes 5 manually by an operator after the carrier route sequencing is completed. At this time, the address codes 15 or handwritten addresses of the sheets or the like 2 after carrier route sequencing must be read one by one by visual observation of the operator in order to search the places where such sheets or the like 2 are to be inserted.

Figures 30, 32:
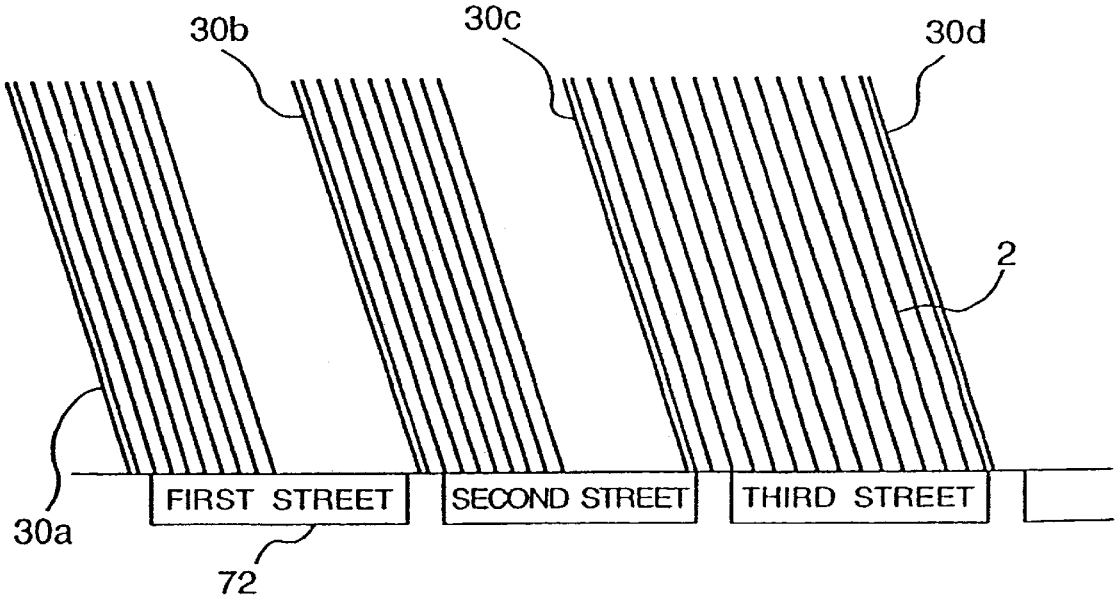
FIG. 30 is a diagram showing one example of the display contents in displayer device used for the sheet or the like sorting apparatus according to the invention.
FIG. 32 is a diagram showing another example of the display contents in displayer devices used for the sheet or the like sorting apparatus according to the invention.

FIG. 30 is a diagram showing one embodiment of displayer devices for displaying a sorting completed state when carrier route sequencing is completed. FIG. 30 shows one embodiment of the display contents of the displayer devices 14 of FIG. 1. As shown in FIG. 30, it is one example of display of the stacking sections when carrier route sequencing is completed, and ranges of addresses of the sheets or the like 2 stacked in the respective stacking sections. When an address of a sheet or the like 2 to be inserted manually is read and compared with the sorting results, it can be found which stacking section this sheet or the like must be inserted into.

Figure 31:
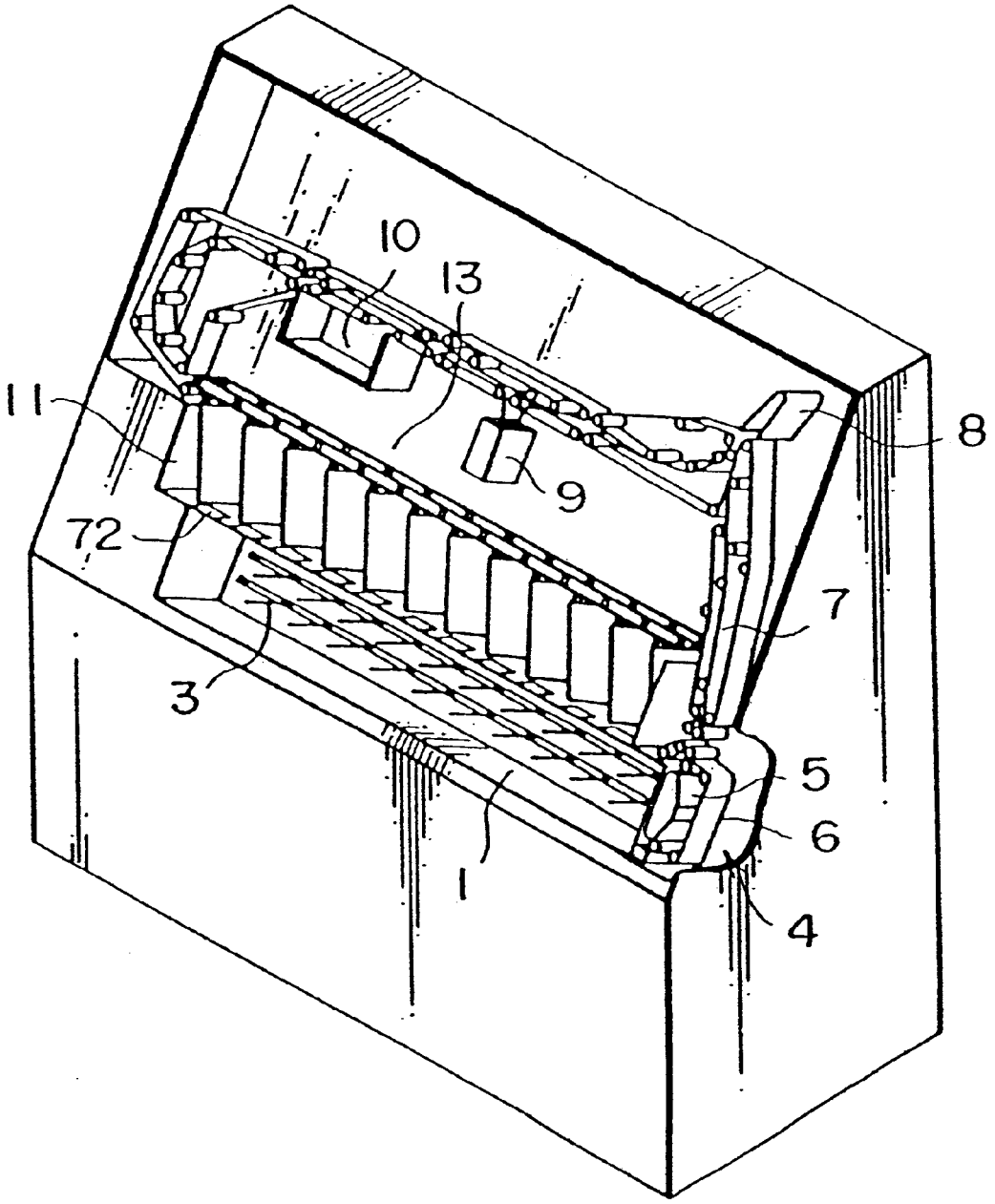
FIG. 31 is a perspective view showing a further embodiment of a sheet or the like sorting apparatus according to the invention.

FIGS. 31 and 32 are diagrams showing another embodiment of displayer devices for displaying a sorting completed state. In FIG. 31, reference numeral 72 denotes displayer devices corresponding to each of the stacking sections S1 to S12, which are provided in the vicinity of the stacking section. Display control devices 69 control the display contents of the displayer devices 72. FIG. 32 shows one example of the display contents of the displayer devices 72, showing ranges of addresses of the sheets or the like 2 sorted and stacked in the respective stacking sections S1 to S12 when the sorting is completed. When an address of a sheet or the like 2 to be inserted manually is read and compared with the displayed sorting results, it can be found which stacking section this sheet or the like must be inserted into. In this embodiment, individual displayer devices 72 are provided for each of the stacking sections. However, displayer devices may be provided for, for example, every two adjacent stacking sections.

In the case where sheets or the like of an address code 15 have a plurality of delivery points, their hand-written addresses must be read for confirmation by visual observation of an operator after carrier route sequencing in the serial order of the address codes 15 has been finished, and the sheets or the like must be sequenced in accordance with the delivery points. In such a case, address codes 15 which require confirmation are inputted in advance by the sorting information input devices 71, and a stacking section including such address codes can be easily found by different displayer devices, for example, lighting an indicator lamp, or blinking display of the displayer devices 14 or 72 corresponding to the stacking section in question, or displaying information in a different color.

According to the present invention, over flowing of sheets or the like from the stacker devices can be prevented by properly restricting the number of sheets or the like to be fed at one time on the basis of the thickness and the amount of sheets or the like.

The stacker devices of sheets or the like are provided on an upper portion of the feeder devices, and the sheets or the like can be recovered from the stacker devices by letting the sheets or the like fall down into the feeder devices. Therefore, the sheets or the like need not be shifted for sequencing from the stacker devices into the feeder devices by human labor, and also, the sheets or the like can be moved in an extremely short period of time, which results in an advantage that time required for the sequencing operation can be shortened.

Display of sorting information of each stacking section when the sequencing is completed is useful, for example, when the sheets or the like which have been discharged from the sheets or the like sorting apparatus are inserted in certain places. Moreover, when a plurality of sheets or the like having an address code must be sequenced by visual observation and confirmation of an operator, the address code in question is inputted in advance so that an indication can be displayed of which stacking section these sheets or the like are stacked in when the sequencing is completed, and such display will be the sign for the operation by the person in charge.

According to the embodiments of the present invention, sheets or the like on which address codes are printed, e.g., mail, can be sequenced in the serial order designated by the address codes, by devices of a small-sized sorting apparatus having about 10 stacking sections. For example, the address codes express delivery points of mail, and the order of the address codes is associated with the carrier route of the mail, so that the mail fed to the sorting apparatus can be sequenced in accordance with the carrier route.

The stacker devices are provided on an upper portion of the feeder devices, and the mail are stacked in substantially standing positions in the stacker devices. Thus, the width of the stacker devices can be made substantially equal to that of the feeder devices, and the longitudinal length of the whole sorting apparatus can be about 2 m. Both the width of the stacker devices and the width of the feeder devices are not more than 2 m so that an operator can reach the mail in the stacker devices and the feeder devices by hand without moving around, thereby lessening the labor of the operator.

Moreover, because the stacker devices are provided on the upper portion of the feeder devices, devices like a tray for shifting mail are not necessary when the mail sorted to and stacked in the stacker devices are supplied to the feeder devices again. The mail is simply moved from the stacker devices on an upper shelf to the feeder devices on a lower shelf. Therefore, even if the mail is manually shifted from the stacker devices to the feeder devices, the shifting operation is easy.

Furthermore, because the stacker devices and the feeder devices are located one above the other and in contact with each other, the mail in the stacker devices can be allowed to fall down and move into the feeder devices by providing devices for opening the bottom surface of the stacker devices. With such an arrangement, the sorted mail can be supplied to the feeder devices without manual operation, thus enabling automatic sequencing of the mail in accordance with the carrier route order.

In the above-described embodiments, sheets or the like are held in standing positions. However, the present invention can be applied to the case where sheets or the like are placed in horizontal positions.

What is claimed is:

1. An apparatus for sorting and distributing sheet-like items, said apparatus comprising:

a feeder unit for feeding sheet-like items, said feeder unit having a bottom surface;

a stacker unit for stacking the sheet-like items, said stacker unit having a bottom surface normally positioned at a first distance above said bottom surface of said feeder unit;

a bottom surface opening mechanism for opening said bottom surface of said stacker unit to permit sheet-like items stacked in said stacker unit to be transferred to said feeder unit; and a bottom surface moving mechanism for causing said bottom surface of said feeder unit and said bottom surface of said stacker unit to move toward each other so as to position said stacker unit bottom surface at a second distance above said feeder unit bottom surface, said second distance being less than said first distance, and for causing said bottom surface of said feeder unit and said bottom surface of said stacker unit to move away from each other to position said stacker unit at the first distance above said feeder unit.

2. An apparatus in accordance with claim 1, wherein said bottom surface moving mechanism causes said bottom surface of said feeder unit to move toward and away from said bottom surface of said stacker unit.

3. An apparatus in accordance with claim 1, wherein said bottom surface moving mechanism causes said bottom surface of said stacker unit to move toward and away from said bottom surface of said feeder unit.

4. An apparatus in accordance with claim 1, wherein said bottom surface moving mechanism causes a portion of said bottom surface of said feeder unit to move toward and away from said bottom surface of said stacker unit.

5. An apparatus in accordance with claim 1, wherein said bottom surface opening mechanism is responsive to said stacker unit bottom surface and said feeder unit bottom surface reaching the position at which said bottom surface of said stacker unit is positioned at the second distance above said bottom surface of said feeder unit, for opening said bottom surface of said stacker unit to permit sheet-like items stacked in said stacker unit to be transferred to said feeder unit.

6. An apparatus in accordance with claim 5, wherein said bottom surface moving mechanism causes said bottom surface of said feeder unit to move toward and away from said bottom surface of said stacker unit.

7. An apparatus in accordance with claim 5, wherein said bottom surface moving mechanism causes said bottom surface of said stacker unit to move toward and away from said bottom surface of said feeder unit.

8. An apparatus in accordance with claim 5, wherein said bottom surface moving mechanism causes a portion of said bottom surface of said feeder unit to move toward and away from said bottom surface of said stacker unit.

* * * * *